US011293617B2

(12) United States Patent
Kinoshita et al.

(10) Patent No.: US 11,293,617 B2
(45) Date of Patent: Apr. 5, 2022

(54) VEHICULAR LIGHTING FIXTURE

(71) Applicant: Stanley Electric Co., Ltd., Tokyo (JP)

(72) Inventors: Kayuri Kinoshita, Tokyo (JP); Sadayuki Konishi, Tokyo (JP)

(73) Assignee: STANLEY ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 17/254,277

(22) PCT Filed: May 15, 2019

(86) PCT No.: PCT/JP2019/019271

§ 371 (c)(1),
(2) Date: Dec. 19, 2020

(87) PCT Pub. No.: WO2019/244519

PCT Pub. Date: Dec. 26, 2019

(65) Prior Publication Data

US 2021/0270440 A1 Sep. 2, 2021

(30) Foreign Application Priority Data

Jun. 21, 2018 (JP) ..... JP2018-118349

(51) Int. Cl.
*F21S 41/60* (2018.01)
*F21S 41/24* (2018.01)
(Continued)

(52) U.S. Cl.
CPC ..... *F21S 41/60* (2018.01); *F21S 41/143* (2018.01); *F21S 41/24* (2018.01); *F21S 41/25* (2018.01); *F21S 41/40* (2018.01); *F21W 2102/13* (2018.01)

(58) Field of Classification Search
None
See application file for complete search history.

(56) References Cited

U.S. PATENT DOCUMENTS

2019/0162385 A1* 5/2019 Paradis ..... B60Q 1/2607

FOREIGN PATENT DOCUMENTS

JP 2015-79660 A 4/2015
JP 2018-83533 A 5/2018
(Continued)

OTHER PUBLICATIONS

International Search Report and Written Opinion of the International Search Report for PCT/JP2019/019271 dated Aug. 6, 2019.

*Primary Examiner* — Elmito Breval
(74) *Attorney, Agent, or Firm* — Kenealy Vaidya LLP

(57) ABSTRACT

Provided is a vehicle lighting fixture capable of suppressing the luminous intensity at a portion (e.g., a portion around 4 degrees below the horizontal line) of a low-beam light distribution pattern from becoming relatively high, and also capable of forming a low-beam light distribution pattern with a uniform vertical thickness with respect to the horizontal direction. The vehicle lighting fixture includes a projection lens, a separator disposed behind the projection lens, and a low-beam light source that is disposed behind the separator and emits light for forming a low-beam light distribution pattern by being irradiated forward through the separator and the projection lens in this order. This vehicle lighting fixture is characterized in that: the separator includes an upper separator body that has a front surface and a rear surface on the opposite side thereof, and a first light guide portion that extends from a lower portion of the upper separator body toward the low-beam light source and has a first light incident surface located at a tip end thereof and faces the low-beam light source; that the projection lens has a front surface and a rear surface on the opposite side thereof, and the rear surface of the projection lens has an upper light incident surface facing the front surface of the upper separate body; that the low-beam light source, the first light guide portion, the upper separator body, and the upper
(Continued)

light incident surface are each disposed above a reference axis passing through the focal point of the projection lens and extending in a vehicle longitudinal direction; that the lower portion of the front surface of the upper separator body is in surface contact with the lower portion of the upper light incident surface of the rear surface of the projection lens; and that a space is formed between a portion above the lower portion of the front surface of the upper separator body and a portion above the lower portion of the upper light incident surface of the rear surface of the projection lens.

7 Claims, 27 Drawing Sheets

(51) Int. Cl.

| | |
|---|---|
| ***F21S 41/25*** | (2018.01) |
| ***F21S 41/143*** | (2018.01) |
| ***F21S 41/40*** | (2018.01) |
| *F21W 102/13* | (2018.01) |

(56) References Cited

FOREIGN PATENT DOCUMENTS

| | | | |
|---|---|---|---|
| WO | 2018/117230 | A1 | 6/2018 |
| WO | 2018/123850 | A1 | 7/2018 |
| WO | 2019/244519 | A1 | 12/2019 |

* cited by examiner (a)

(b)

(a)

(b)

VEHICULAR LIGHTING FIXTURE

This application is a U.S. National Stage Application under 35 U.S.C § 371 of International Patent Application No. PCT/JP2019/019271 filed May 15, 2019, which claims the benefit of priority to Japanese Patent Application No. 2018-118349 filed Jun. 21, 2018, the disclosures of all of which are hereby incorporated by reference in their entireties.

TECHNICAL FIELD

The present invention relates to a vehicle lighting fixture, and in particular, to a vehicle lighting fixture capable of preventing the luminous intensity at a portion (e.g., a portion around 4 degrees below the horizontal line) of a low-beam light distribution pattern from becoming relatively high, and also capable of forming a low-beam light distribution pattern with a uniform vertical thickness in a horizontal direction.

BACKGROUND ART

Conventionally, there has been proposed a vehicle lighting fixture including a projection lens constituted by a first lens and a second lens, a light guide lens disposed behind the projection lens, and a low-beam light source that is disposed behind the light guide lens and emits light for forming a low-beam light distribution pattern by being irradiated forward through the light guide lens and the projection lens in this order (e.g., see Patent Literature 1 (FIG. 1, etc.)).

CITATION LIST

Patent Literature

Patent Document 1: Japanese Patent Application Laid-Open No. 2015-79660

SUMMARY OF INVENTION

Problem Solved by the Invention

However, the present inventors have studied the foregoing vehicle lighting fixture made in accordance with the conventional art described above, and found that although the vehicle lighting fixture satisfies the legal requirements for the low-beam light distribution pattern, the luminous intensity at a portion (e.g., a portion around 4 degrees below the horizontal line) of the low-beam light distribution pattern becomes relatively high to cause luminous intensity unevenness (luminance unevenness), and the thickness of the central portion of the low-beam light distribution pattern becomes smaller than those at both left and right ends, and as a result, the light distribution feeling is reduced.

The present invention has been made in view of the foregoing circumstances, and an object thereof is to provide a vehicle lighting fixture capable of suppressing the luminous intensity at a portion (e.g., a portion around 4 degrees below the horizontal line) of the low-beam light distribution pattern from becoming relatively high, and also capable of forming a low-beam light distribution pattern with a uniform vertical thickness with respect to the horizontal direction (i.e., it is possible to suppress the light distribution feeling from being reduced).

Means for Solving the Problem

To achieve the foregoing object, an aspect of the present invention is a vehicle lighting fixture including a projection lens, a separator disposed behind the projection lens, and a low-beam light source that is disposed behind the separator and emits light for forming a low-beam light distribution pattern by being irradiated forward through the separator and the projection lens in this order. This vehicle lighting fixture is characterized in that: the separator includes an upper separator body that includes a front surface and a rear surface on the opposite side thereof, and a first light guide portion that extends from a lower portion of the upper separator body toward the low-beam light source and has a first light incident surface located at a tip end thereof and faces the low-beam light source; that the projection lens has a front surface and a rear surface on the opposite side thereof, and the rear surface of the projection lens has an upper light incident surface facing the front surface of the upper separate body; that the low-beam light source, the first light guide portion, the upper separator body, and the upper light incident surface are each disposed above a reference axis passing through the focal point of the projection lens and extending in a vehicle longitudinal direction; that the lower portion of the front surface of the upper separator body is in surface contact with the lower portion of the upper light incident surface of the rear surface of the projection lens; that a space is formed between a portion above the lower portion of the front surface of the upper separator body and a portion above the lower portion of the upper light incident surface of the rear surface of the projection lens; and that the light emitted from the low-beam light source enters the first light guide portion through the first light incident portion, and a part of the light is directly outputted from the front surface of the upper separator body, and another part of the light is guided within the upper separator body while being repeatedly totally reflected between the front surface and the rear surface of the upper separator body and then outputted through the front surface of the upper separator body and further enters the projection lens through the upper light incident surface of the projection lens to be projected by the projection lens, so that the light is used for forming the low-beam light distribution pattern.

In the above-described invention, a preferable mode is characterized in that a distance between the front surface of the upper separator body and the upper light incident surface of the rear surface of the projection lens becomes wider upward.

In the above-described invention, a preferable mode is characterized in that the surface shape of the upper light incident surface of the rear surface of the projection lens is adjusted in such a manner that the luminous intensity distribution of the low-beam light distribution pattern satisfies the legal requirements and the thickness of the low-beam light distribution pattern in the vertical direction is uniform with respect to the horizontal direction.

Further, in the above-described invention, a preferable mode is characterized by further including an ADB light source that emits light that is irradiated forward while passing the separator and the projection lens in this order to form an ADB light distribution pattern, and in that the separator includes a lower separator body that includes a front surface and a rear surface on the opposite side thereof, and a second light guide portion that extends from an upper portion of the lower separator body toward the ADB light source and has a second light incident surface located at a tip end thereof and facing the ABD light source; that the rear surface of the projection lens further has a lower light incident surface facing the front surface of the lower separator body; that the ADB light source, the second light guide portion, the lower separator body, and the lower light incident surface are each disposed below the reference axis; and that the front surface of the lower separator body is in surface contact with the lower light incident surface of the rear surface of the projection lens.

DESCRIPTION OF EMBODIMENTS

Figure 1:
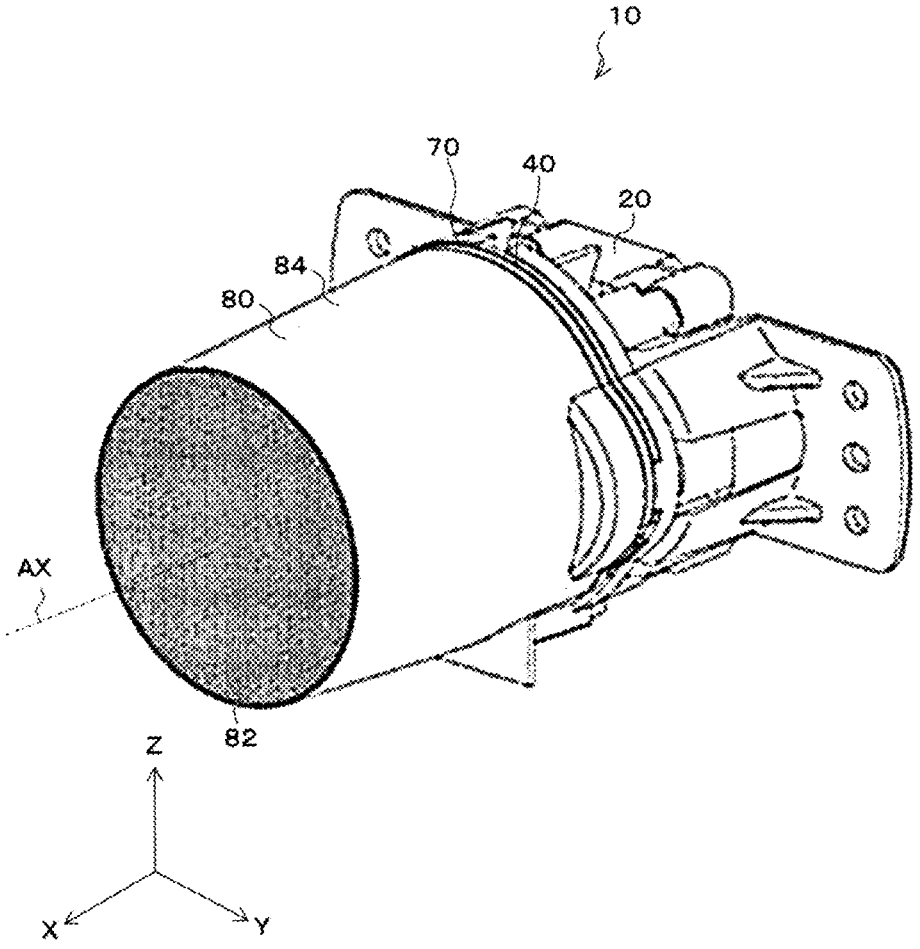
FIG. 1 is a perspective view of a vehicle lighting fixture 10.

Hereinafter, a vehicle lighting fixture 10, which is an embodiment of the present invention, will be described with reference to the accompanying drawings. Corresponding components in the respective drawings are denoted by the same reference numerals, and a repetitive description thereof will be omitted.

Figure 2:
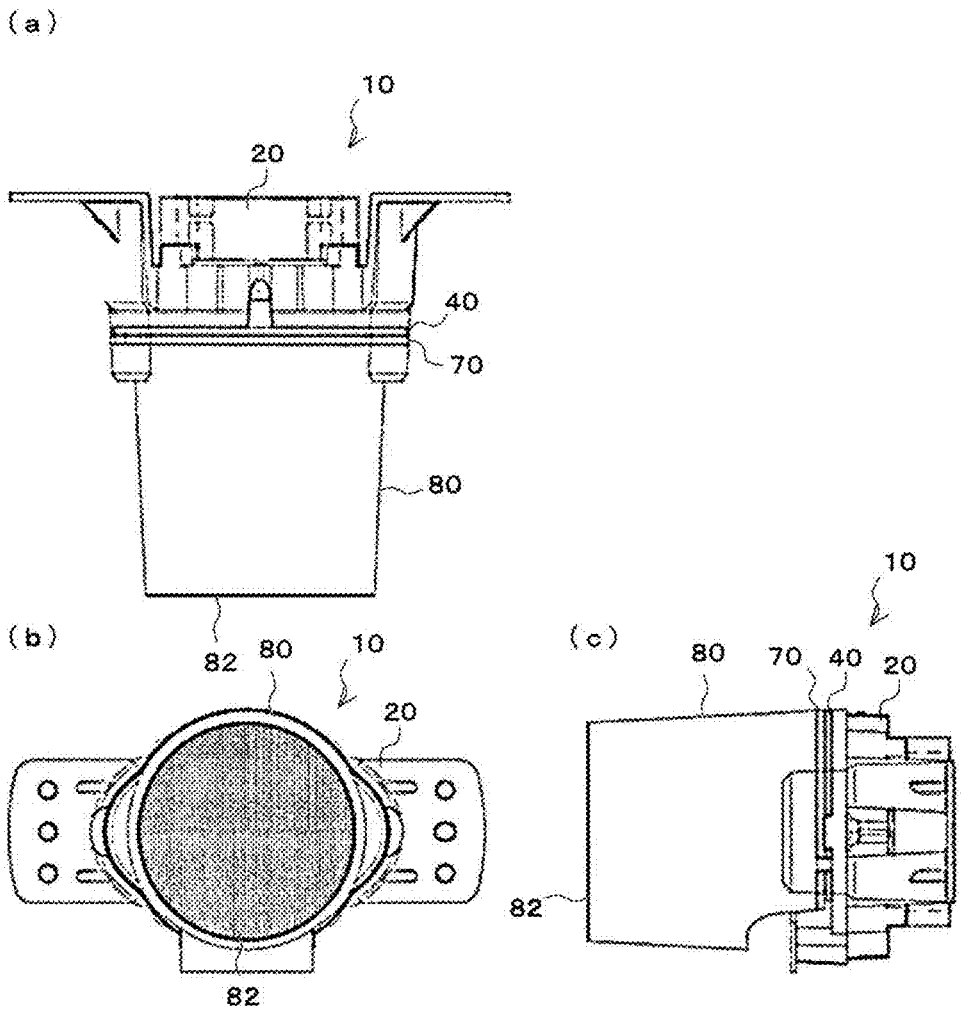
FIG. 2(*a*) is a top view of the vehicle lighting fixture 10, (*b*) is a front view thereof, and (*c*) is a side view thereof.

FIG. 1 is a perspective view of a vehicle lighting fixture 10. FIG. 2(*a*) is a top view of the vehicle lighting fixture 10, FIG. 2(*b*) is a front view thereof, and FIG. 2(*c*) is a side view thereof.

Figure 9:
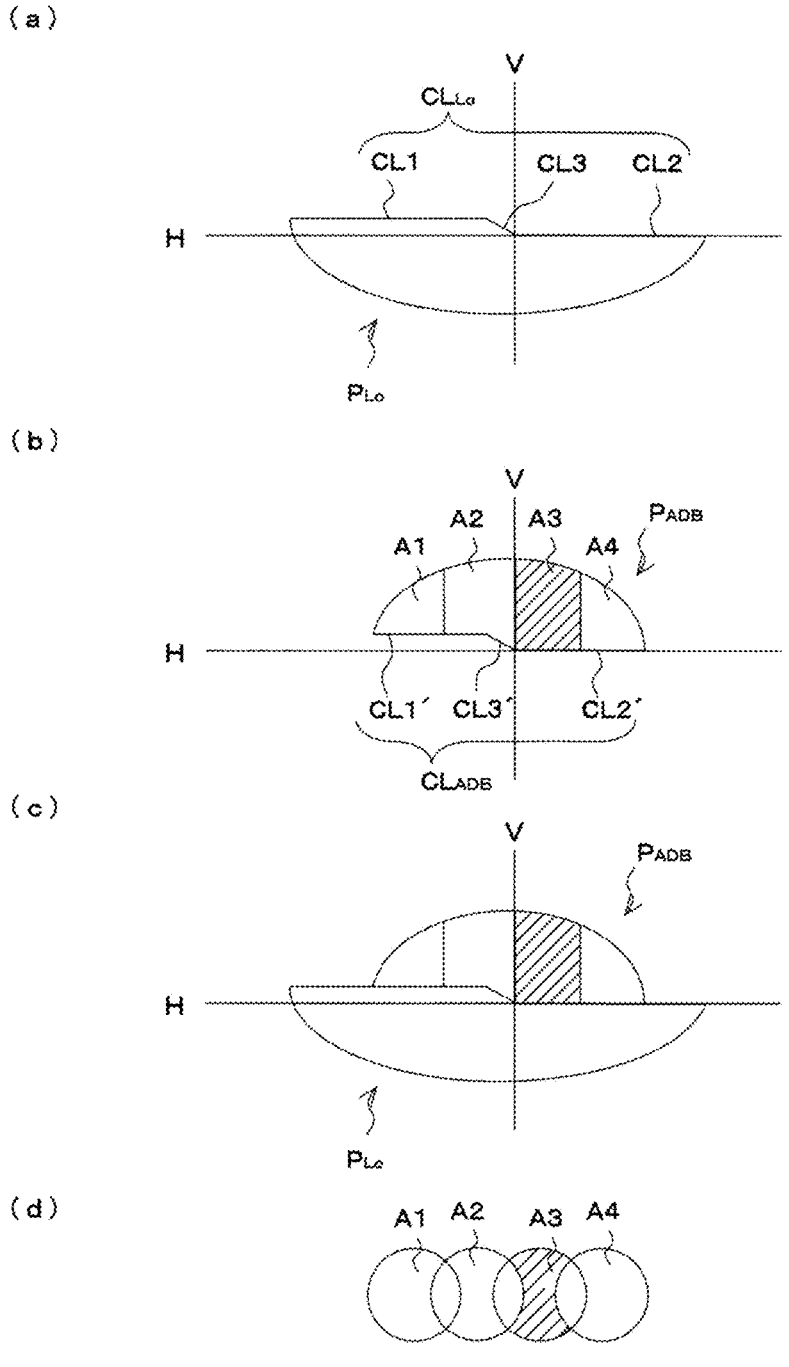
FIG. 9(*a*) is a diagram showing an example of a low-beam light distribution pattern $P_{Lo}$, (*b*) is a diagram showing an example of an ADB light distribution pattern $P_{ADB}$, (*c*) is a diagram showing an example of a composite light distribution pattern including the low-beam light distribution pattern $P_{Lo}$ and the ADB light distribution pattern $P_{ADB}$, and (*d*) is a diagram showing a state in which a plurality of regions (e.g., a plurality of regions A1 to A4 that are individually turned on and off) constituting the ADB light distribution pattern mutually overlap with one another while being formed in a circle.

The vehicle lighting fixture 10 shown in FIGS. 1 and 2 is a vehicle headlamp that is capable of forming a low-beam light distribution pattern $P_{Lo}$ (see FIG. 9(*a*)) or a composite light distribution pattern including the low-beam light distribution pattern $P_{Lo}$ and an ADB (Adaptive Driving Beam) light distribution pattern $P_{ADB}$ (see FIG. 9(*c*)), and that is mounted on the left and right sides of a front end portion of a vehicle (not shown). The low-beam light distribution pattern $P_{Lo}$ and the ADB light distribution pattern $P_{ADB}$ are formed on a virtual vertical screen facing the vehicle front (disposed in front of the vehicle front about 25 m away therefrom). Incidentally, hereinafter, for convenience of description, XYZ axes are defined. The X-axis extends in the vehicle longitudinal direction, the Y-axis extends in the vehicle width direction, and the Z-axis extends in the vertical direction.

Figure 3:
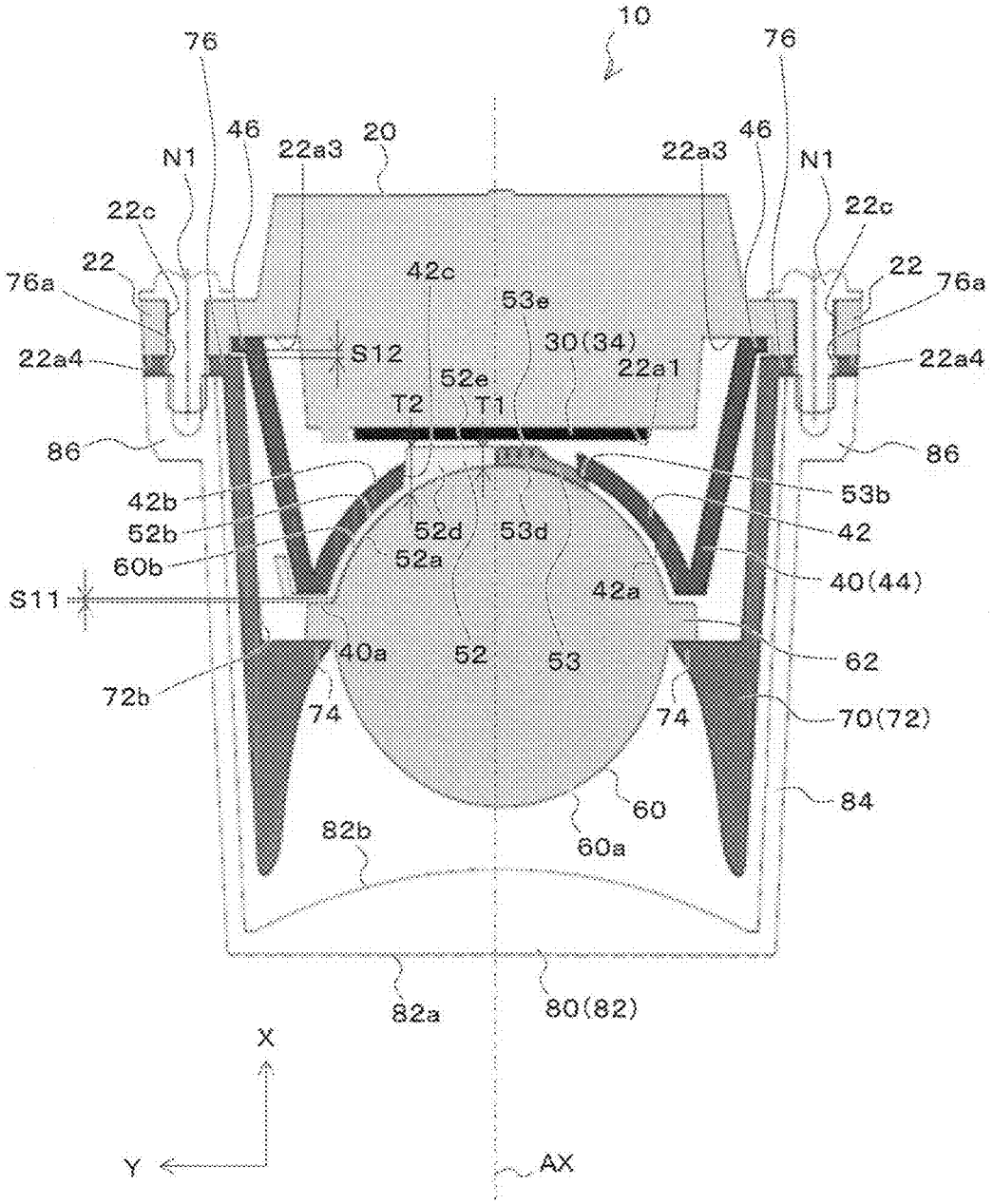
FIG. 3 is a cross-sectional view of the vehicle lighting fixture 10 shown in FIG. 1 taken along a horizontal plane including a reference axis AX (a plane including the X-axis and Y-axis).
Figure 4:
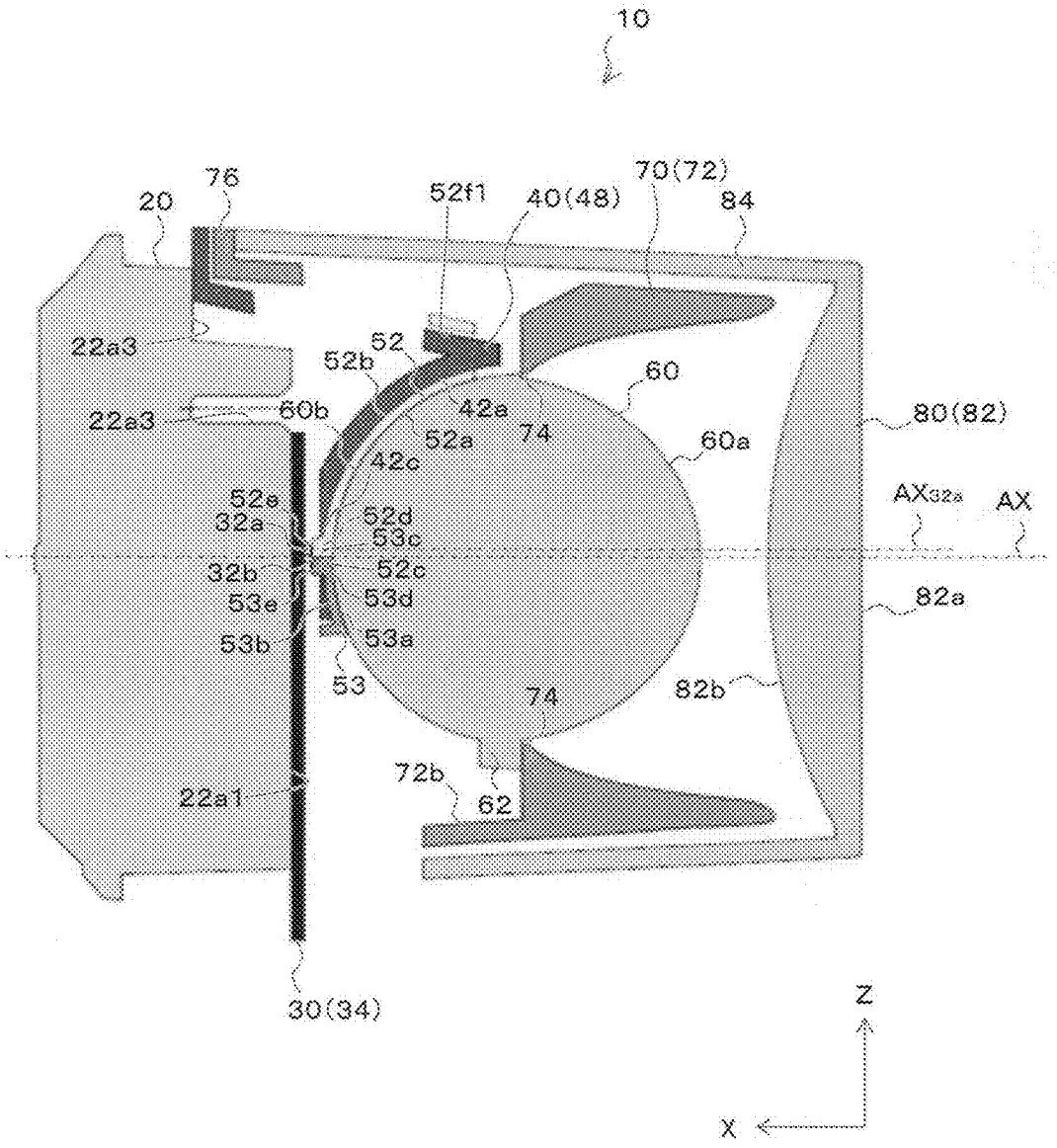
FIG. 4 is a cross-sectional view of the vehicle lighting fixture 10 shown in FIG. 1 taken along a vertical plane including the reference axis AX (a plane including the X-axis and Z-axis).
Figure 5:
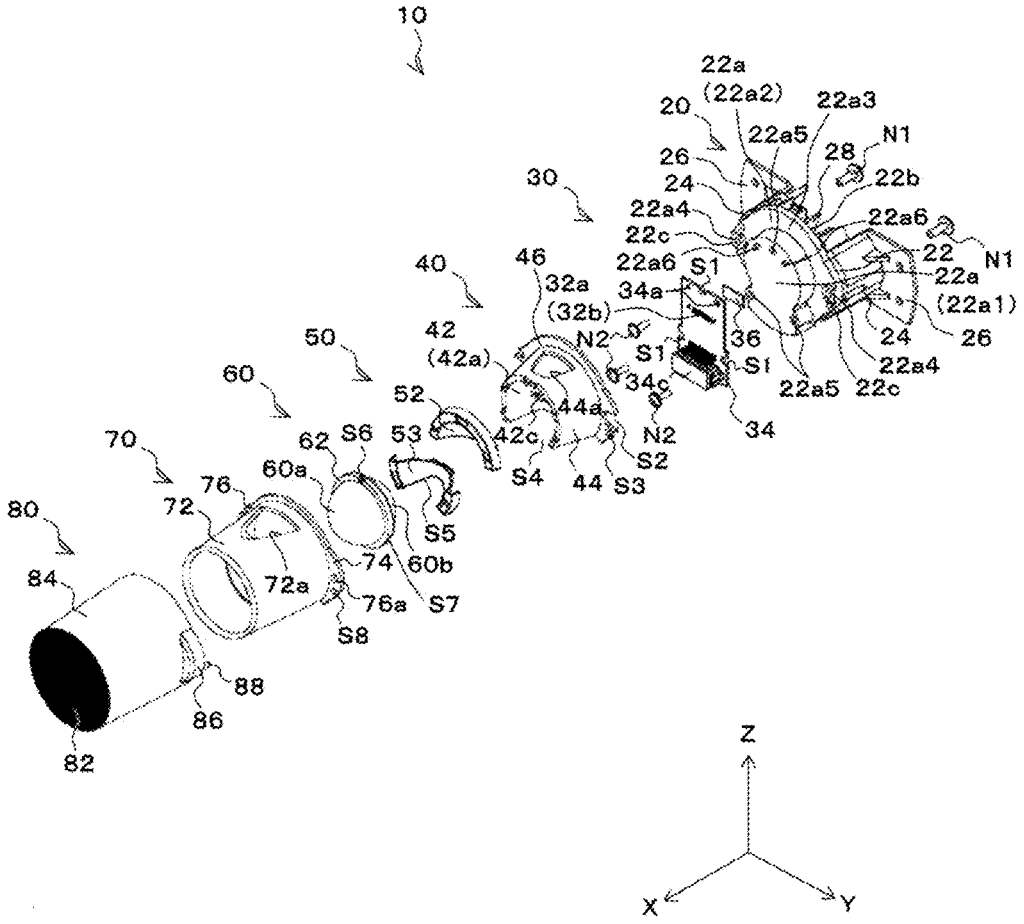
FIG. 5 is an exploded perspective view of the vehicle lighting fixture 10.

FIG. 3 is a cross-sectional view of the vehicle lighting fixture 10 shown in FIG. 1 taken along a horizontal plane including a reference axis AX (a plane including the X-axis and Y-axis). FIG. 4 is a cross-sectional view of the vehicle lighting fixture 10 shown in FIG. 1 taken along a vertical plane including the reference axis AX (a plane including the X-axis and Z-axis). FIG. 5 is an exploded perspective view of the vehicle lighting fixture 10.

As shown in FIGS. 3 to 5, the vehicle lighting fixture 10 of the present embodiment includes a heat sink 20, a light source module 30, a holder 40, a separator 50, a primary lens 60, a retainer 70, a secondary lens 80, and the like. The vehicle lighting fixture 10, although not shown, is disposed in a lamp chamber constituted by an outer lens and a housing, and is attached to the housing or the like.

As shown in FIG. 5, the heat sink 20 includes a base 22 made of aluminum die cast and including a front surface 22*a* and a rear surface 22*b* on the opposite side.

The front surface 22*a* includes a light source module mounting surface 22*a*1 and a peripheral surface 22*a*2 surrounding the light source module mounting surface 22*a*1.

The light source module mounting surface 22*a*1 and the peripheral surface 22*a*2 are each, for example, a plane parallel to a plane including the Y-axis and the Z-axis.

Screw holes 22*a*5 are provided in the light source module mounting surface 22*a*1 (in FIG. 5, at three portions) in order to screw the light source module 30. Further, positioning pins 22*a*6 are provided to the light source module mounting surface 22*a*1 (in FIG. 5, at two portions) in order to position the light source module 30.

The peripheral surface 22*a*2 includes a holder abutment surface 22*a*3 against which the holder 40 abuts, and a retainer abutment surface 22*a*4 against which the retainer 70 abuts.

The retainer abutment surface 22*a*4 is provided on each of the left and right sides of the peripheral surface 22*a*2.

The thickness between the retainer abutment surface 22*a*4 and the rear surface 22*b* (thickness in the X-axis direction) is thicker than the thickness between the holder abutment surface 22*a*3 and the rear surface 22*b* (thickness in the X-axis direction), so as to constitute a step portion.

Screw holes 22*c*, into which screw N1 is inserted, are provided in the base 22 (in FIG. 3, at two portions). The screw holes 22*c* penetrate the base 22 from the retainer abutment surface 22*a*4 to the rear surface 22*b*.

First extension portions 24 are provided to the left and right sides of the base 22 to extend from the left and right sides of the base 22 rearward (X-axis direction). At the tip end portion of the first extension portion 24, a second extension portion 26 extending sideward (Y-axis direction) is provided.

Heat dissipation fins 28 are provided to the rear surface 22*b* of the base 22.

The light source module 30 includes a plurality of low-beam light sources 32*a* and a plurality of ADB light sources 32*b*, and a substrate 34 on which the plurality of low-beam light sources 32*a*, the plurality of ADB light sources 32*b*, and connectors 34*c* are mounted.

Figure 8:
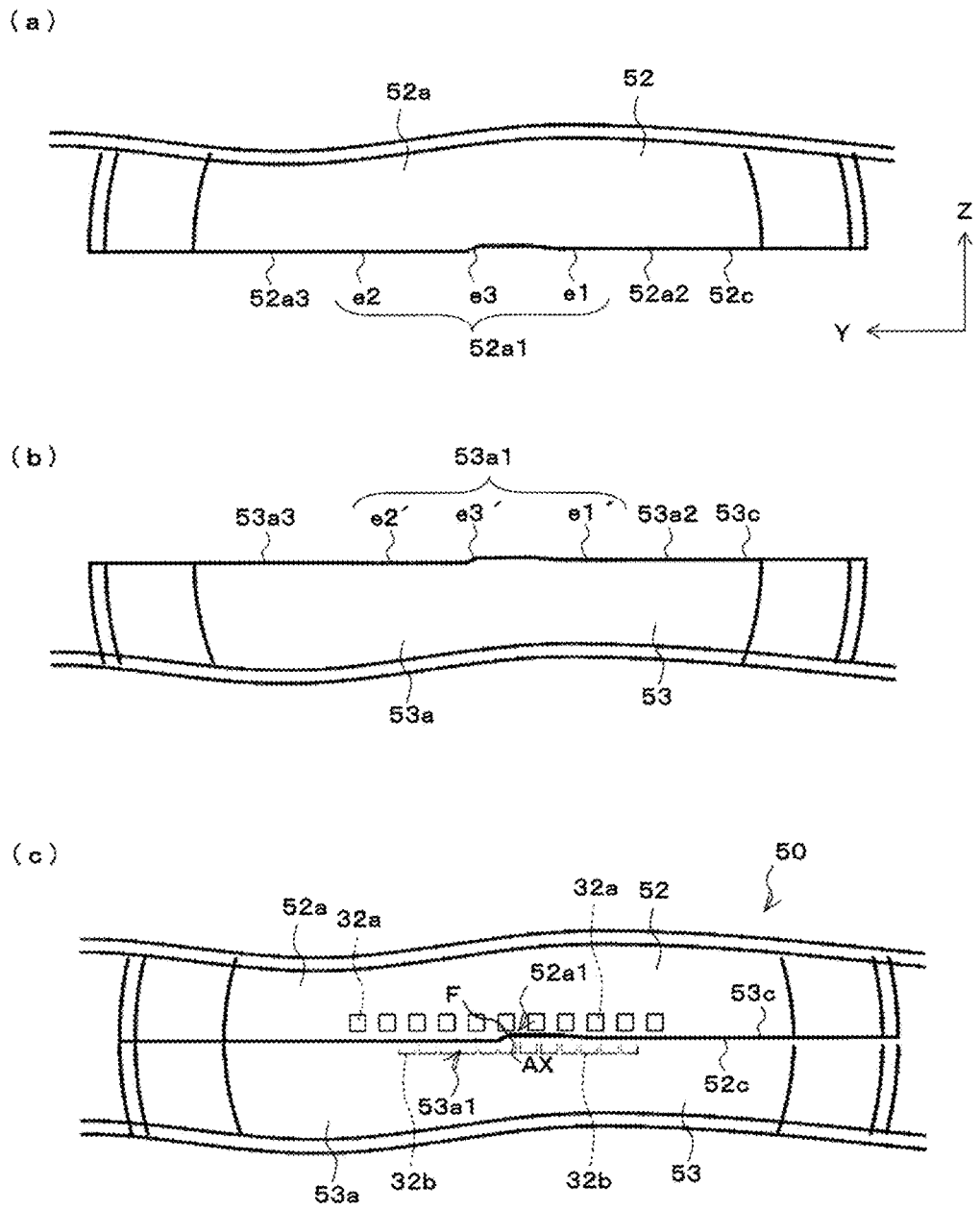
FIG. 8(*a*) is a partial front view of an upper separator body 52, (*b*) is a partial front view of a lower separator body 53, and (*c*) is a front view (perspective view) of a plurality of low-beam light sources 32*a* and a plurality of ADB light sources 32*b* when seen through the separator 50.

FIG. 8(*c*) is a front view (perspective view) of the plurality of low-beam light sources 32*a* and the plurality of ADB light sources 32*b* when seen through the separator 50.

As shown in FIG. 8(*c*), the plurality of low-beam light sources 32*a* are mounted on the substrate 34 in a form in which they are arranged in the upper stage and along the Y-axis direction. The plurality of ADB light sources 32*b* are mounted on the substrate 34 in a form in which they are arranged in the lower stage and along the Y-axis direction.

Each of the light sources 32*a*, 32*b* is, for example, a semiconductor light emitting element such as an LED or LD with a light emitting surface of a rectangular (e.g., 1 mm square), and is mounted on the substrate 34 in a state in which the respective light emitting surface is directed forward (front). A plurality of rectangles in FIG. 8(*c*) represent the light emitting surfaces of the respective light sources 32*a* and 32*b*.

In the substrate 34, there are provided through holes 34*a* into which positioning pins 22*a*6 of the heat sink 20 are inserted (in FIG. 5, at two portions) and notches S1 in which screws N2 are inserted (in FIG. 5, at three portions).

A light source module 30 with the above-described configuration is fixed to the heat sink 20 by screwing the screws N2 inserted into the notches S1 to the screw holes 22*a*5 of the heat sink 20 (the light source module mounting surface 22*a*1), while the positioning pins 22*a*6 of the heat sink 20 are inserted into the through holes 34*a* of the substrate 34.

As shown in FIGS. 3 to 5, the holder 40 is made of a synthetic resin such as an acrylic resin or a polycarbonate resin, and includes a cup-shaped holder main body 42 in which a front side is opened and a rear side is closed.

The holder body 42 has a front surface 42*a* that is configured as a surface with the following shape (or a concave spherical surface to the rear). The front surface 42*a* is formed by inverting the rear surface of the separator 50 so that the rear surface of the separator 50 (rear surface 52*b* of the upper separator body 52 and the rear surface 53*b* of the lower separator body 53) is in surface contact with the front surface 42*a*.

In the holder body 42, a through hole 42*c* in which the first light guide portion 52*d* and the second light guide portion 53*d* of the separator 50 are inserted is provided.

To the holder body 42, a cylindrical portion 44 extending toward the rear (X-axis direction) from the outer peripheral portion of the holder body 42 is provided. Then, at the tip end portion of the cylindrical portion 44, a flange portion 46 to abut against the holder abutment surface 22*a*3 of the heat sink 20 is provided.

In the holder main body 42 (and the cylindrical portion 44), a notch S4 is provided.

On the front side open end surface 40*a* of the holder 40, projected portions 48 and projected portions 49 are provided.

Figure 6:
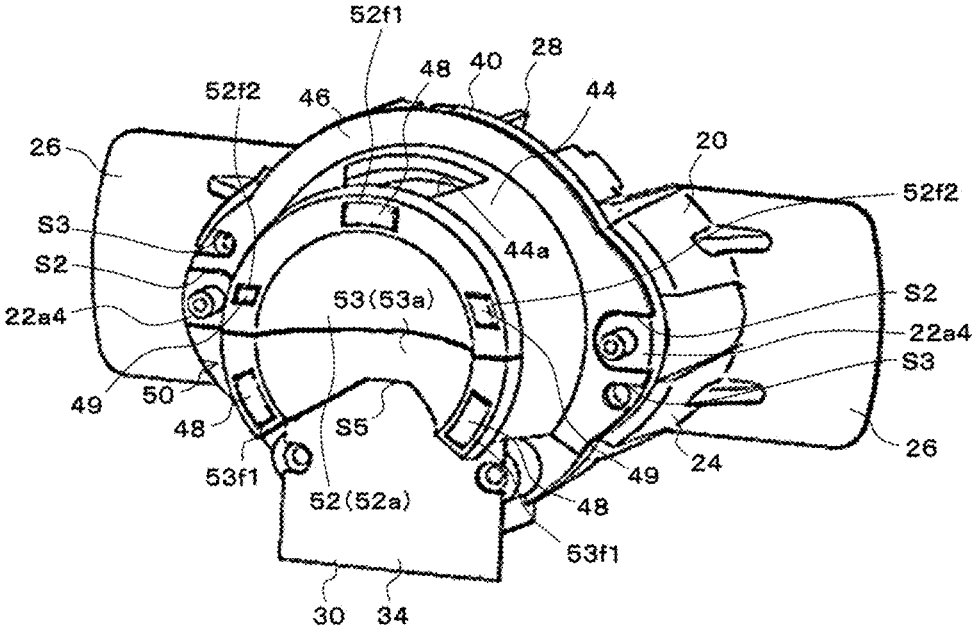
FIG. 6 is a perspective view of a structure in which a heat sink 20, a light source module 30, a holder 40, and a separator 50 are combined.

FIG. 6 is a perspective view of a structure which has the heat sink 20, the light source module 30, the holder 40, and the separator 50 in combination.

Figure 7:
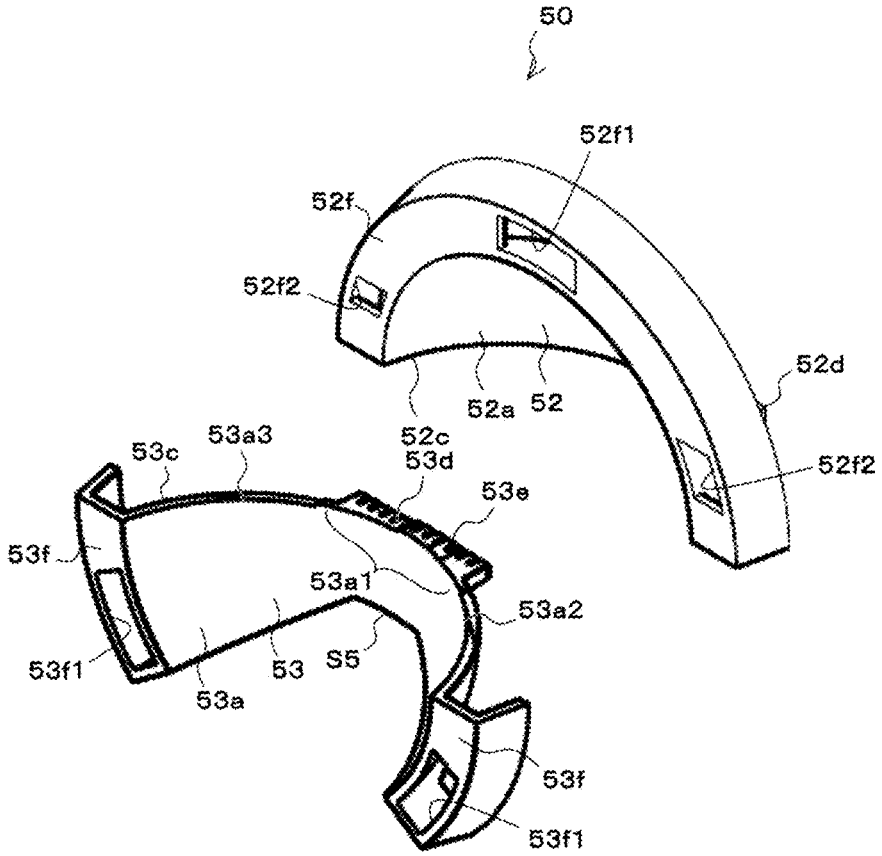
FIG. 7 is a perspective view of the separator 50.

FIG. 7 is a perspective view of the separator 50.

As shown in FIG. 7, the separator 50 is a cup-shaped member made of a silicone resin and which has an open front side and a closed rear side. The separator 50 includes an upper separator body 52 and a lower separator body 53.

As shown in FIG. 4, the upper separator body 52 is disposed above the reference axis AX, and the lower separator body 53 is disposed below the reference axis AX. The reference axis AX extends in the X-axis direction.

The upper separator body 52 has a front surface 52*a* that is configured as a surface with a shape (concave spherical surface to the rear) that is formed by inverting the upper half of the rear surface 60*b* of the primary lens 60 so that the upper half, above the reference axis AX, of the rear surface 60*b* of the primary lens 60 (convex spherical surface to the rear) is in surface contact with the front surface 52*a*.

The upper separator body 52 has a rear surface 52*b* (see FIGS. 3 and 4) that is configured as a surface with a shape (convex spherical surface to the rear) that is formed by inverting the upper half of the front surface 42*a* of the holder 40 (holder body 42) so that the upper half, above the reference axis AX, of the front surface 42*a* (concave spherical surface to the front) of the holder 40 (holder body 42) is in surface contact with the rear surface 52*b*.

As shown in FIG. 8(*a*), the lower edge of the front surface 52*a* of the upper separator body 52 includes a stepped edge portion 52*a*1 with the shape corresponding to a cut-off line $CL_{Lo}$ (CL1 to CL3) and extended edge portions 52*a*2 and 52*a*3 disposed on both sides of the stepped edge portion 52*a*1. The extended edge portion may be provided on only one side.

The stepped edge portion 52*a*1 includes a side e1 corresponding to the left horizontal cut-off line CL1, a side e2 corresponding to the right horizontal cut-off line CL2, and a side e3 corresponding to the oblique cut-off line CL3 connecting the left horizontal cut-off line CL1 and the right horizontal cut-off line CL2.

The extended edge portion 52*a*2 is disposed at the same position as the side e1 with respect to the Z-axis direction. The extended edge portion 52*a*3 is disposed at the same position as the side e2 with respect to the Z-axis direction.

The upper separator body 52 has a lower end surface 52*c* (see FIG. 4). The lower end surface 52*c* is a surface extending from the lower edge of the front surface 52*a* of the upper separator body 52 toward the rear surface 52*b* of the upper separator body 52 in the horizontal direction (X-axis direction).

As shown in FIGS. 3 and 4, in order to guide the light from the light source module 30 (a plurality of low-beam light sources 32*a*), a first light guide portion 52*d* is provided to the rear surface 52*b* of the upper separator body 52. The first light guide portion 52*d* has a proximal end portion that is provided in a partial region including the stepped edge portion 52*a*1 of the rear surface 52*b* of the upper separator body 52, and extends toward the light source module 30 (the plurality of low-beam light sources 32*a*). It should be noted that the partial region including the stepped edge portion 52*a*1 is a region where the light source module 30 (the light emitting surfaces of the plurality of low-beam light sources 32*a*) faces the rear surface 52*b* of the upper separator body 52. The first light guide portion 52*d* is inserted into the through hole 42*c* of the holder 40.

A first light incident surface 52*e* is provided at the tip end portion of the first light guide portion 52*d*. The first light incident surface 52*e* is, for example, a plane parallel to a plane including the Y-axis and the Z-axis.

The first light incident surface 52*e* is disposed at a position where it faces the light source module 30 (the light emitting surfaces of the plurality of low-beam light sources 32*a*) (see FIG. 4) in a state in which the first light guide portion 52*d* is inserted into the through hole 42*c* of the holder 40. The distance between the first light incident surface 52*e* and the light source module 30 (the light emitting surfaces of the plurality of low-beam light sources 32*a*) is, for example, 0.2 mm.

As shown in FIGS. 5 and 7, a flange portion 52*f* is provided to the front side open end surface of the upper separator body 52. The flange portion 52*f* has a through hole 52*f*1 into which the projected portion 48 of the holder 40 is inserted (in FIGS. 5 and 7, at one portion), and through holes 52*f*2 into which the projected portions 49 of the holder 40 are inserted (in FIGS. 5 and 7, at two portions).

The lower separator body 53 has a front surface 53*a* that is configured as a surface with a shape (concave spherical surface to the rear) that is formed by inverting the lower half of the rear surface 60*b* of the primary lens 60 so that the lower half, below the reference axis AX, of the rear surface 60*b* of the primary lens 60 (convex spherical surface to the rear) is in surface contact with the front surface 53*a*.

The lower separator body 53 has a rear surface 53*b* (see FIGS. 3 and 4) that is configured as a surface with a shape (convex spherical surface to the rear) that is formed by inverting the lower half of the front surface 42*a* of the holder 40 (holder body 42) so that the lower half, below the reference axis AX, of the front surface 42*a* (concave spherical surface to the front) of the holder 40 (holder body 42) is in surface contact with the rear surface 53*b*.

As shown in FIG. 8(*b*), the upper edge of the front surface 53*a* of the lower separator body 53 includes a stepped edge portion 53*a*1 (sides e1' to e3') with a shape obtained by inverting the stepped edge portion 52*a*1, and extended edge portions 53*a*2 and 53*a*3 disposed on both sides of the stepped edge portion 53*a*1. The extended edge portion may be provided on only one side.

The extended edge portion 53*a*2 is disposed at the same position as the side e1' with respect to the Z-axis direction. The extended edge portion 53*a*3 is disposed at the same position as the side e2' with respect to the Z-axis direction.

The lower separator body 53 has an upper end surface 53*c* (see FIG. 4). The upper end surface 53*c* is a surface extending from the upper edge of the front surface 53*a* of the lower separator body 53 toward the rear surface 53*b* of the lower separator body 53 in the horizontal direction (X-axis direction).

As shown in FIGS. 3 and 4, in order to guide the light from the light source module 30 (a plurality of ADB light sources 32*b*), a second light guide portion 53*d* is provided to the rear surface 53*b* of the lower separator body 53. The second light guide portion 53*d* has a proximal end portion that is provided in a partial region including the stepped edge portion 53*a*1 of the rear surface 53*b* of the lower separator body 53, and extends toward the light source module 30 (the plurality of ADB light sources 32*b*). It should be noted that the partial region including the stepped edge portion 53*a*1 is a region where the light source module 30 (the light emitting surfaces of the plurality of ADB light sources 32*b*) faces the rear surface 53*b* of the lower separator body 53. The second light guide portion 53*d* is inserted into the through hole 42*c* of the holder 40.

A second light incident surface 53*e* is provided at the tip end portion of the second light guide portion 53*d*. The second light incident surface 53*e* is a surface adjusted such that a plurality of regions constituting the ADB light distribution pattern (e.g., a plurality of regions A1 to A4 which are individually turned on and off) are prevented from becoming circular and overlapping with each other as shown in FIG. 9(*d*), and such that, as shown in FIG. 9 (*b*) the regions are formed in a state of being divided by vertical edges. FIGS. 9(*b*) and 9(*d*) show an ADB light distribution pattern formed when four ADB light sources 32*b* are provided. The hatched areas in FIGS. 9(*b*) and 9(*d*) indicate that the ADB light sources 32*b* corresponding to the area are turned off.

The second light incident surface 53*e* is disposed at a position where it faces the light source module 30 (the light emitting surfaces of the plurality of ADB light sources 32*b*) (see FIG. 4) in a state in which the second light guide portion 53*d* is inserted into the through hole 42*c* of the holder 40. The distance between the second light incident surface 53*e* and the light source module 30 (the light emitting surfaces of the plurality of ADB light sources 32*b*) is, for example, 0.2 mm.

As shown in FIGS. 5 and 7, a flange portion 53*f* is provided to the front side open end surface of the lower separator body 53. The flange portion 53*f* has through holes 53*f*1 into which the projected portions 48 of the holder 40 are inserted (in FIGS. 5 and 7, at two portions).

It should be noted that the lower separator body 53 has a notch S5 so that the connectors 34*c* of the light source module 30 do not abut against (interfere with) the lower separator body 53.

As shown in FIG. 8(*c*), the upper separator body 52 and the lower separator body 53 constitute the separator 50 in combination in a state in which the lower edge of the front surface 52*a* of the upper separator body 52 and the upper edge of the front surface 53*a* of the lower separator body 53 are in line contact with each other and the lower end surface 52*c* of the upper separator body 52 and the upper end surface 53*c* of the lower separator body 53 are in surface contact with each other.

The separator 50 with the above-described configuration is disposed in such a manner that the first light guide portion 52*d* of the upper separator body 52 and the second light guide portion 53*d* of the upper separator body 52 are inserted into the through holes 42*c* of the holder 40 (e.g., press-fit or fit), that the first light incident surface 52*e* of the upper separator body 52 (the first light guide portion 52*d*) and the light source module 30 (the light emitting surfaces of the plurality of low-beam light sources 32*a*) face each other and the second light incident surface 53*e* of the lower separator body 53 (the second light guide portion 53*d*) and the light source module 30 (the light emitting surfaces of the plurality of ADB light sources 32*b*) face each other (see FIGS. 3 and 4), and that the rear surface of the separator 50 (the rear surface 52*b* of the upper separator body 52 and the rear surface 53*b* of the lower separator body 53) is in surface contact with the front surface 42*a* of the holder 40 (holder body 42) (see FIGS. 3 and 4).

At that time, the projected portions 48 of the holder 40 are inserted into the through hole 52*f*1 of the upper separator body 52 and the through holes 53*f*1 of the lower separator body 53 (see FIG. 6). Furthermore, the projected portions 49 of the holder 40 are also inserted into the through holes 52*f*2 of the upper separator body 52 (see FIG. 6).

As shown in FIG. 5, the primary lens 60 is a spherical lens that includes a front surface 60*a* and a rear surface 60*b* on an opposite side thereof. The front surface 60*a* is a spherical surface convex to the front, and the rear surface 60*b* is a spherical surface convex to the rear. The primary lens 60 includes a flange portion 62. The flange portion 62 extends between the front surface 60*a* and the rear surface 60*b* so as to surround the reference axis AX.

As shown in FIG. 5, the retainer 70 includes a retainer body 72 that is made of a synthetic resin such as an acrylic resin or a polycarbonate resin and that includes a cylindrical body that widens in a conical shape from the front side open end surface toward the rear side open end surface.

As shown in FIG. 5, the secondary lens 80 is made of a synthetic resin such as an acrylic resin or a polycarbonate resin, and includes a lens body 82.

The lens body 82 includes a front surface 82*a* and a rear surface 82*b* on the opposite side thereto (see FIGS. 3 and 4). The front surface 82*a* is a plane parallel to the plane including the Y-axis and the Z-axis, and the rear surface 82*b* is a convex spherical surface to the rear.

To the outer peripheral portion of the lens body 82, a cylindrical portion 84 extending from the outer peripheral portion of the lens body 82 toward the rear (X-axis direction) is provided.

The primary lens 60 and the secondary lens 80 constitute a projection lens with a focal point F (see FIG. 8(*c*)) located in the vicinity of the lower edge (the stepped edge portion 52*a*1) of the front surface 52*a* of the upper separator body 52 and the upper edge (the stepped edge portion 53*a*1) of the front surface 53*a* of the lower separator body 53. The curvature of field of the projection lens (rear focal plane) substantially coincides with the lower edge (the stepped edge portion 52*a*1) of the front surface 52*a* of the upper separator body 52 and the upper edge (the stepped edge portion 53*a*1) of the front surface 53*a* of the lower separator body 53.

As the primary lens 60 and the secondary lens 80 constituting the projection lens, for example, a spherical lens and a plano-convex lens described in Japanese Patent Application Laid-Open No. 2015-79660 may be used.

The secondary lens 80 with the above-described configuration has the lens body 82 disposed in front of the primary lens 60, and a pressing and screw receiving portion 86 disposed in contact with the flange portion 76 of the retainer 70 (see FIGS. 3 and 4).

In the vehicle lighting fixture 10 with the above-described configuration, when the plurality of low-beam light sources 32*a* are turned on, light from the plurality of low-beam light sources 32*a* is incident on the first light incident surface 52*e* of the first light guide portion 52*d* of the upper separator body 52, is guided within the first light guide portion 52*d* and is outputted from the front surface 52*a* of the upper separator body 52. As a result, the luminous intensity distribution corresponding to the low-beam light distribution pattern is formed on the front surface 52*a* of the upper separator body 52. The luminous intensity distribution includes the sides e1 to e3 (see FIG. 8A) corresponding to the cut-off line $CL_{Lo}$ (CL1 to CL3). The projection lens, which is constituted by the primary lens 60 and the secondary lens 80, reverses and projects this luminous intensity distribution forward. Thus, as shown in FIG. 9(*a*), this forms the low-beam light distribution pattern $P_{Lo}$ including the cut-off line CL (CL1 to CL3) at the upper edge.

When the plurality of ADB light sources 32*b* are turned on, light from the plurality of ADB light sources 32*b* is incident on the second light incident surface 53*e* of the second light guide portion 53*d* of the lower separator body 53, is guided within the second light guide portion 53*d*, and is outputted from the front surface 53*a* of the lower separator body 53. As a result, the luminous intensity distribution corresponding to the ADB light distribution pattern is formed on the front surface 53*a* of the lower separator body 53. The luminous intensity distribution includes the sides e1' to e3' (see FIG. 8(*b*)) corresponding to the cut-off line $CL_{ADB}$ (CL1' to CL3'). The projection lens, which is constituted by the primary lens 60 and the secondary lens 80, reverses and projects this luminous intensity distribution forward. Thus, as shown in FIG. 9(*b*), this forms the ADB light distribution pattern $P_{ADB}$ including the cut-off line $CL_{ADB}$ (CL1' to CL3') at the lower edge. FIG. 9(*b*) shows the ADB light distribution patterns $P_{ADB}$ formed when the number of the plurality of ADB light sources 32*b* is four. The hatched area in FIG. 9(*b*) indicates that the ADB light sources 32*b* corresponding to that area are turned off.

When the plurality of low-beam light sources 32*a* and the plurality of ADB light sources 32*b* are turned on, the composite light distribution pattern including the low-beam light distribution pattern $P_{Lo}$ and the ADB light distribution pattern $P_{ADB}$ is formed as shown in FIG. 9(*c*).

The present inventors have studied and found that the conventional vehicle lighting fixture with the above-described conventional art configuration, although satisfying the legal requirements for the low-beam light distribution pattern, forms the low-beam light distribution pattern with a portion (e.g., a portion around 4 degrees below the horizontal line) whose luminous intensity becomes relatively high, and, for example, causes luminous intensity unevenness (luminance unevenness), resulting in reducing the light distribution feeling.

The reason why the luminous intensity at a portion of the low-beam light distribution pattern (e.g., a portion around 4 degrees below the horizontal line) becomes high is that, of the light from the low-beam light source 32*a*, light whose luminous intensity is relatively strong (e.g., light in a narrow angle direction with respect to an optical axis $AX_{32a}$ of the low-beam light source 32*a* (see FIG. 4)) is projected to a portion (e.g., a portion around 4 degrees below the horizontal line) of the low-beam light distribution pattern $P_{Lo}$ by the projection lens constituted by the primary lens 60 and the secondary lens 80.

Figure 10:
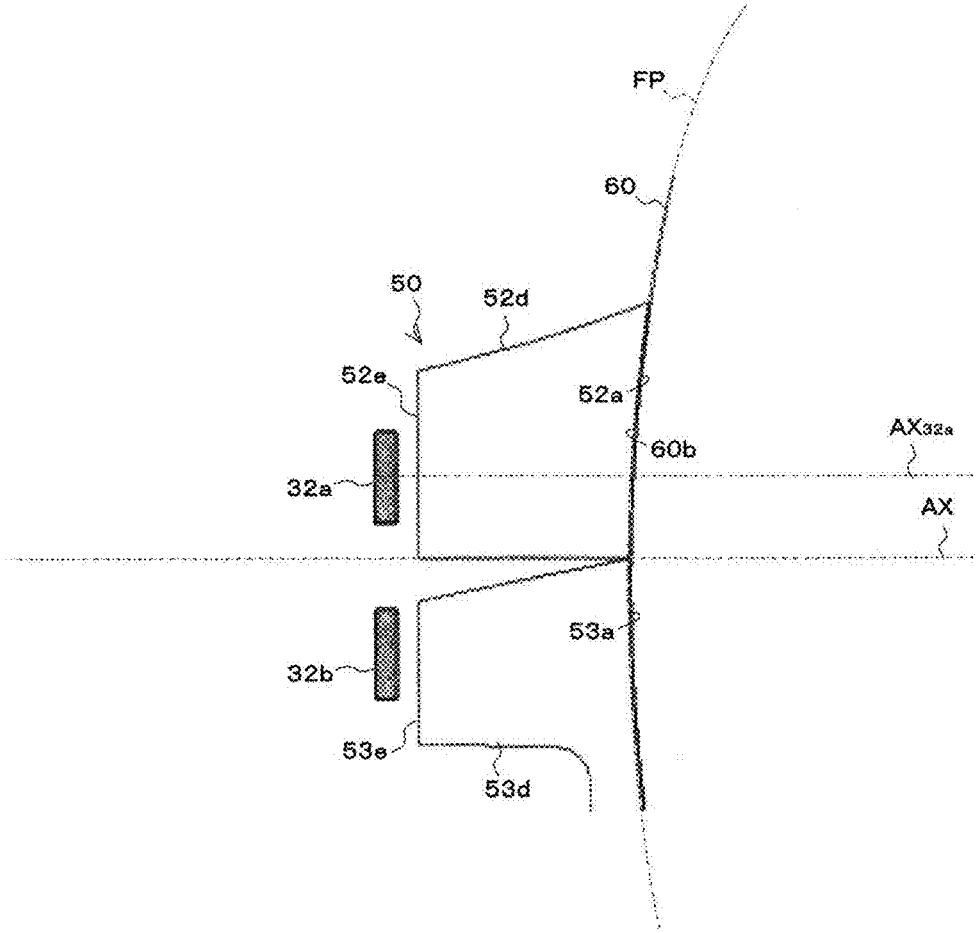
FIG. 10 is a diagram showing an example using a separator without an upper separator body 52 but with only a first light guide portion 52*d* (the same configuration as that of the light guide lens of the above-described conventional art).

FIG. 10 is a diagram showing an example using a separator without an upper separator body 52 but with only a first light guide portion 52*d* (the same light guide lens as that used in the above-described conventional art).

Figure 11:
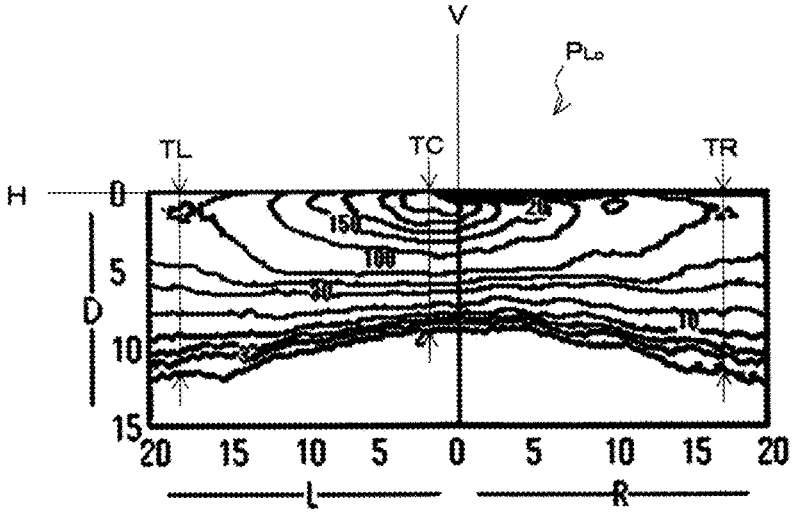
FIG. 11 is a diagram showing an example of a low-beam light distribution pattern $P_{Lo}$ formed when using the separator without an upper separator body 52 but with only the first light guide portion 52*d*.

As shown in FIG. 10, when a separator without an upper separator body 52 but with only the first light guide portion 52*d* is used as the separator 50, it has been found that the luminous intensity at a portion of the low-beam light distribution pattern $P_{Lo}$ (e.g., a portion around 4 degrees below the horizontal line) becomes relatively high, and in addition, as shown in FIG. 11, the thickness TC of the central portion of the low-beam light distribution pattern $P_{Lo}$ becomes thin as compared with the thicknesses TL and TR of both left and right sides thereof, resulting in reduction in the light distribution feeling. FIG. 11 is a diagram showing an example of a low-beam light distribution pattern $P_{Lo}$ formed when a separator without an upper separator body 52 but with only the first light guide portion 52*d* is used.

Although the detailed reason why the thickness TC of the central portion of the low-beam light distribution pattern $P_{Lo}$ becomes thin as compared with the thicknesses TL and TR of both the left and right sides thereof is unknown, it can be considered as follows.

That is, it is considered to be due to that, first, the thickness of the upper separator body 52 along the reference axis AX with respect to the horizontal direction become thicker as it moves away from the reference axis AX (see thicknesses T1 and T2 in FIG. 3), and second, as the light from the low-beam light source 32*a* that transmits the upper separator body 52 through the thicker portion of the upper separator body 52, the optical path length within the upper separator body 52 becomes longer, and thus the light is outputted from the front surface 52*a* of the upper separator body 52 while being greatly diffused in the vertical direction.

For example, of the upper separator body 52, a portion farther from the reference axis AX (e.g., the portion with the thickness T2 in FIG. 3) is thicker than the portion closer to the reference axis AX (e.g., the portion with the thickness T1 in FIG. 3). Therefore, the light from the low-beam light source 32*a* that transmits the upper separator body 52 through a portion farther from the reference axis AX (e.g., a portion with the thickness T2 in FIG. 3) travels along a longer light path within the upper separator body 52 as compared with the light from the low-beam light source 32*a* that transmits a portion thereof near the reference axis AX (e.g., a portion with the thickness T1 in FIG. 3). As a result, it is considered that the thickness TC of the central portion of the low-beam light distribution pattern $P_{Lo}$ is smaller than the thicknesses TL and TR of the left and right sides.

Figure 19:
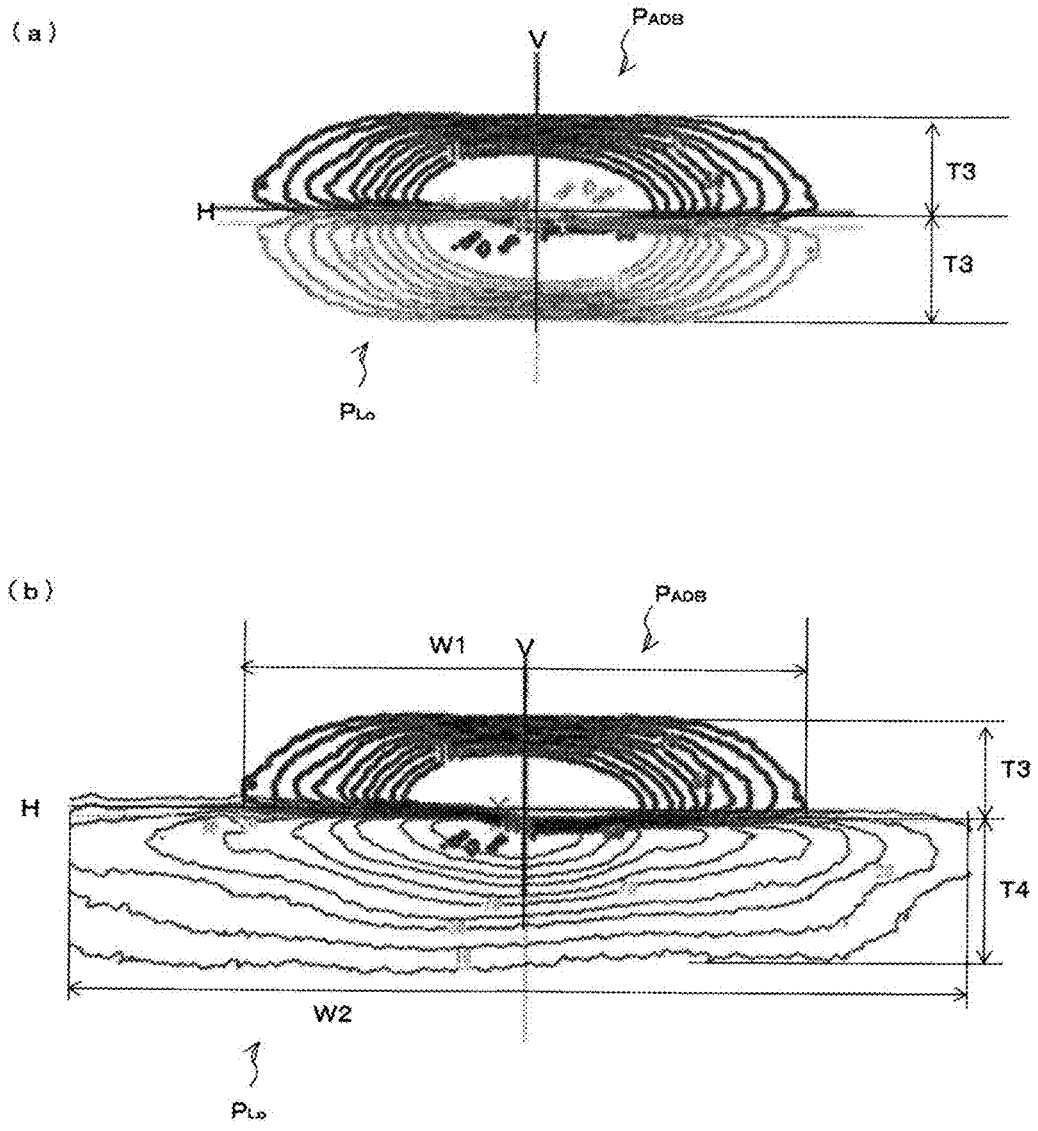
FIG. 19(*a*) is a diagram showing an example of an ADB light distribution pattern and a low-beam light distribution pattern formed when using the separator shown in FIG. 10 (the same light guide lens as that used in the above-described conventional art) and (b) is a diagram showing an example of an ADB light distribution pattern and a low-beam light distribution pattern formed when using the separator shown in FIG. 20 (the same light guide lens as that used in the above-described conventional art).

Further, the present inventors have studied this matter and found that: when the low-beam light distribution pattern is required to have a long length in the vertical direction, a lower density (narrow bright range), and a low maximum luminous intensity as compared with the ADB light distribution pattern, as shown in FIG. 10, if the focal plane FP of the projection lens 90 and the front surface 52*a* of the separator 50 through which light from the low-beam light source 32*a* is outputted (and the rear surface 60*b* of the primary lens 60 on which the light from the low-beam light source 32*a* outputted from the front surface 52*a* of the separator 50 is incident) are each spherical (a spherical surface of constant curvature) and coincide with each other (in surface contact with each other), and if the focal plane FP of the projection lens 90 and the front surface 53*a* of the separator 50 through which the light from the ADB light source 32*b* is outputted (and the rear surface 60*b* of the primary lens 60 on which the light from the ADB light source 32*b* outputted from the front surface 53*a* of the separator 50 is incident) are each spherical (a spherical surface of constant curvature) and coincide with each other (in surface contact with each other), the low-beam light distribution pattern $P_{Lo}$ and the ADB light distribution pattern $P_{ADB}$ have vertically symmetrical shapes and vertically symmetrical luminous intensity distributions as shown in FIG. 19(*a*), so that it is impossible to form the above-mentioned required low-beam light distribution pattern. It has also been found that the contour of the ADB light distribution pattern became clear and the light distribution feeling is reduced. FIG. 19(*a*) shows an example of an ADB light distribution pattern and a low-beam light distribution pattern formed when using the separator shown in FIG. 10 (the same light guide lens as that used in the above-described conventional art).

Next, as a second embodiment, a vehicle lighting fixture 10A capable of preventing the luminous intensity at a portion (e.g., a portion around 4 degrees below the horizontal line) of the low-beam light distribution pattern from becoming relatively high, and also capable of forming a low-beam light distribution pattern with a uniform vertical thickness with respect to the horizontal direction (i.e., it is possible to suppress the light distribution feeling from being reduced) will be described. Note that "uniform" used in this specification is not limited to the meaning of the term uniform in a strict sense. That is, it is considered as being "uniform" as long as it can be visually evaluated as being uniform or substantially uniform.

The vehicle lighting fixture 10A of the present embodiment is different from the vehicle lighting fixture 10 of the above-described first embodiment in that a separator 50A is used instead of the separator 50, and a primary lens 60A is used instead of the primary lens 60. Except for this, the configuration thereof is the same as that of the above-described first embodiment. Hereinafter, differences from the above-described first embodiment will be mainly described, and the same components are denoted by the same reference numerals, and descriptions thereof will be omitted as appropriate.

Figure 12:
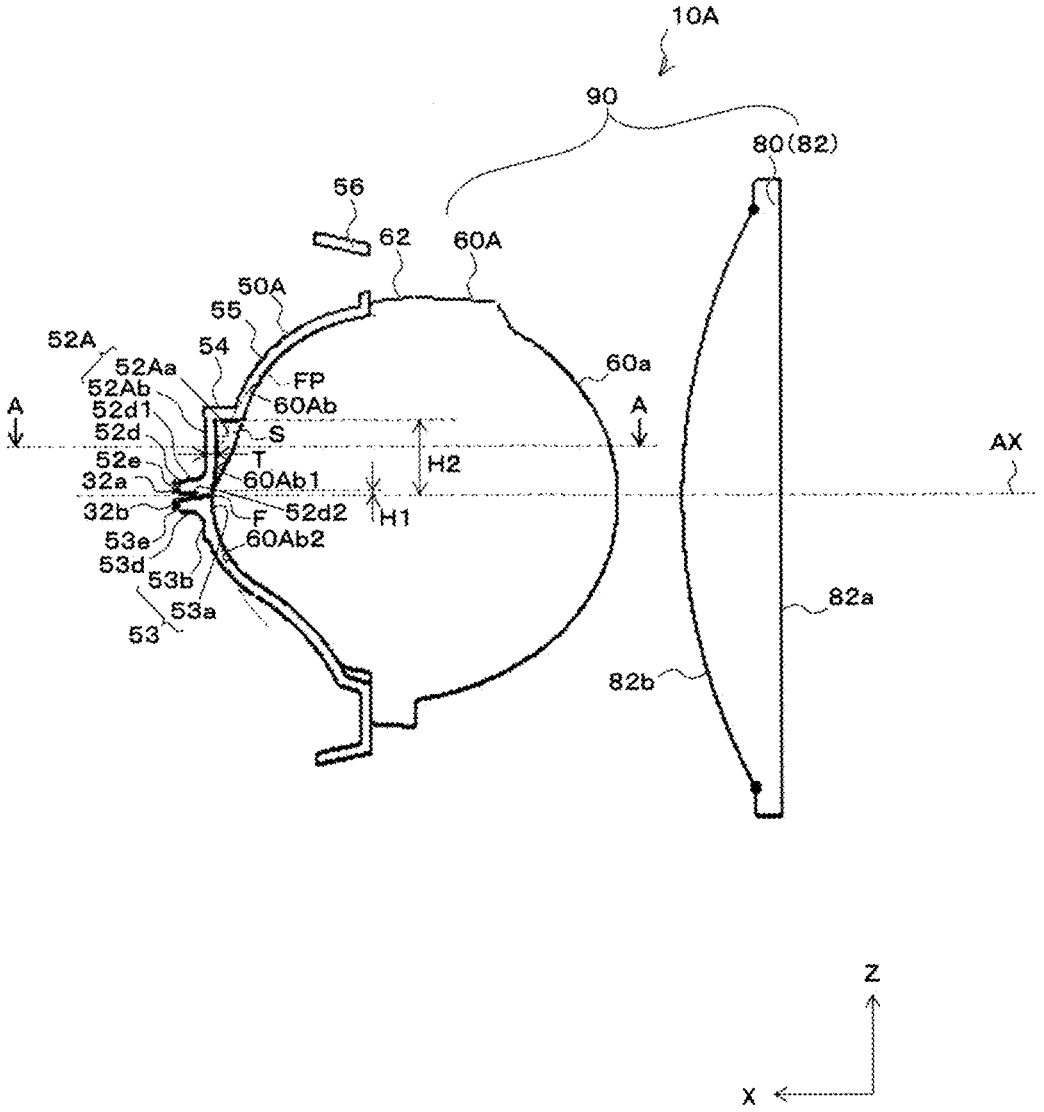
FIG. 12 is a cross-sectional view of a vehicle lighting fixture 10A taken along a vertical plane including the reference axis AX (plane including the X-axis and Z-axis).

FIG. 12 is a cross-sectional view of the vehicle lighting fixture 10A taken along a vertical plane including the reference axis AX (plane including the X-axis and Z-axis).

Figure 13:
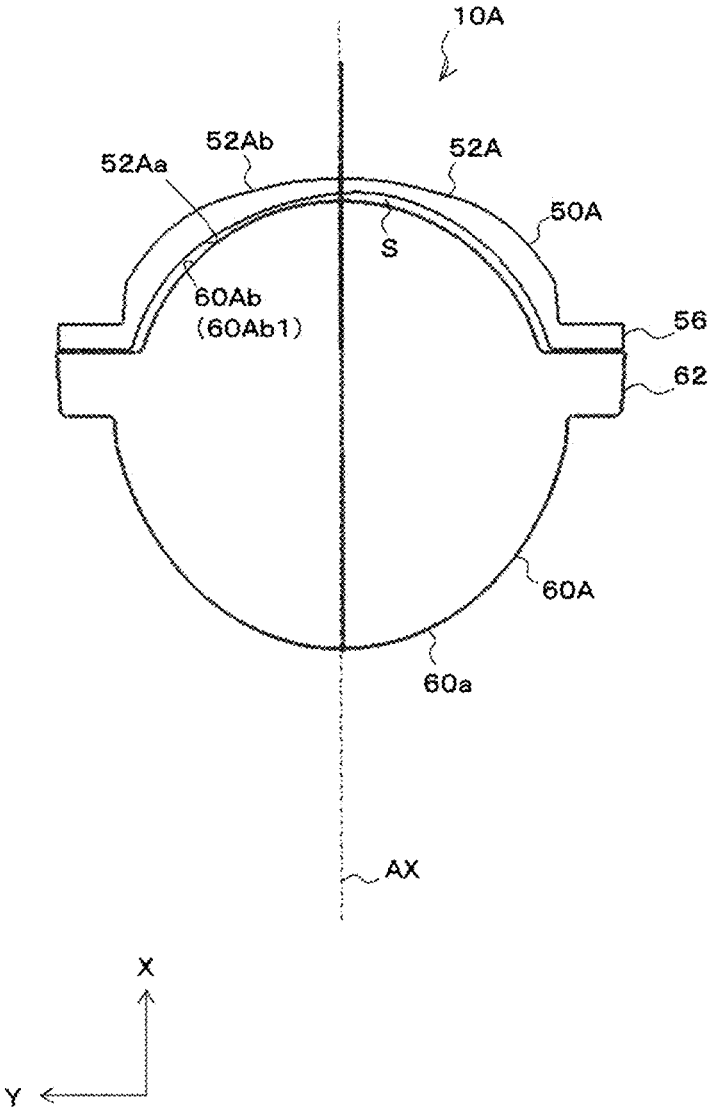
FIG. 13 is a cross-sectional view of the vehicle lighting fixture 10A shown in FIG. 12 taken along line A-A.

FIG. 13 is a cross-sectional view of the vehicle lighting fixture 10A shown in FIG. 12 taken along line A-A. It should be noted that the heat sink 20, the holder 40, the retainer 70 and the like are not illustrated in FIGS. 12 and 13.

As shown in FIGS. 12 and 13, the vehicle lighting fixture 10A includes the secondary lens 80, a primary lens 60A disposed behind the secondary lens 80, a separator 50A disposed behind the primary lens 60A, a plurality of low-beam light sources 32*a* (hereinafter, which may be simply referred to as low-beam light source(s) 32*a*) that are disposed behind the separator 50A and emit light for forming a low-beam light distribution pattern by being irradiated forward through the separator 50A, the primary lens 60A, and the secondary lens 80 in this order, and a plurality of ADB light sources 32*b* (hereinafter, which may be simply referred to as ADB light source(s) 32*b*) that emit light for forming an ADB light distribution pattern by being irradiated forward through the separator 50A, the primary lens 60A, and the secondary lens 80 in this order.

As in the first embodiment, the low-beam light sources 32*a*, the ADB light sources 32*b*, the separator 50A, the primary lens 60A, and the secondary lens 80 are held by the heat sink 20, the holder 40, the retainer 70 and the like to maintain the positional relationship shown in FIG. 12.

The secondary lens 80 (the front surface 82*a* and the rear surface 82*b*) and the primary lens 60A (the front surface 60*a*) constitute a projection lens 90. Specifically, the projection lens 90 is constituted by, out of one or a plurality of lenses (in this embodiment, the primary lens 60A and the secondary lens 80), the optical surface(s) (in this embodiment, the front surface 60*a* of the primary lens 60A and the front surface 82*a* and rear surface 82*b* of the secondary lens 80) other than the rear surface of the rearmost lens (in this embodiment, the rear surface 60Ab of the primary lens 60A). The focal plane FP of the projection lens 90 is, for example, a spherical surface with a constant curvature (see FIG. 20).

As shown in FIG. 12, the focal point F of the projection lens 90 is located between the lower edge of the front surface 52Aa of the upper separator body 52A and the upper edge of the front surface 53*a* of the lower separator body 53 in the vertical direction. Further, the focus F of the projection lens 90, although not shown, is located at the center of the lower edge of the front surface 52Aa of the upper separator body 52A (and the upper edge of the front surface 53*a* of the lower separator body 53) with respect to the horizontal direction. The reference axis AX passes through the focal point F, and extends in the vehicle longitudinal direction (X direction).

Figure 14:
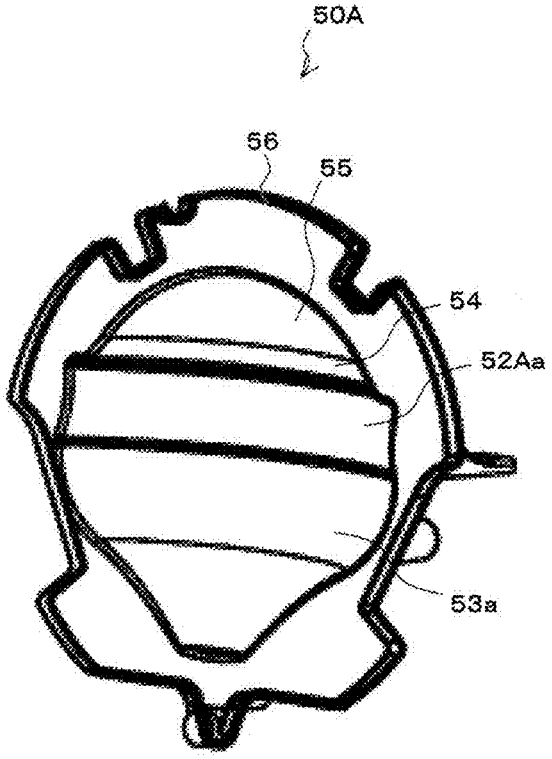
FIG. 14 is a perspective view of a separator 50A.
Figure 15:
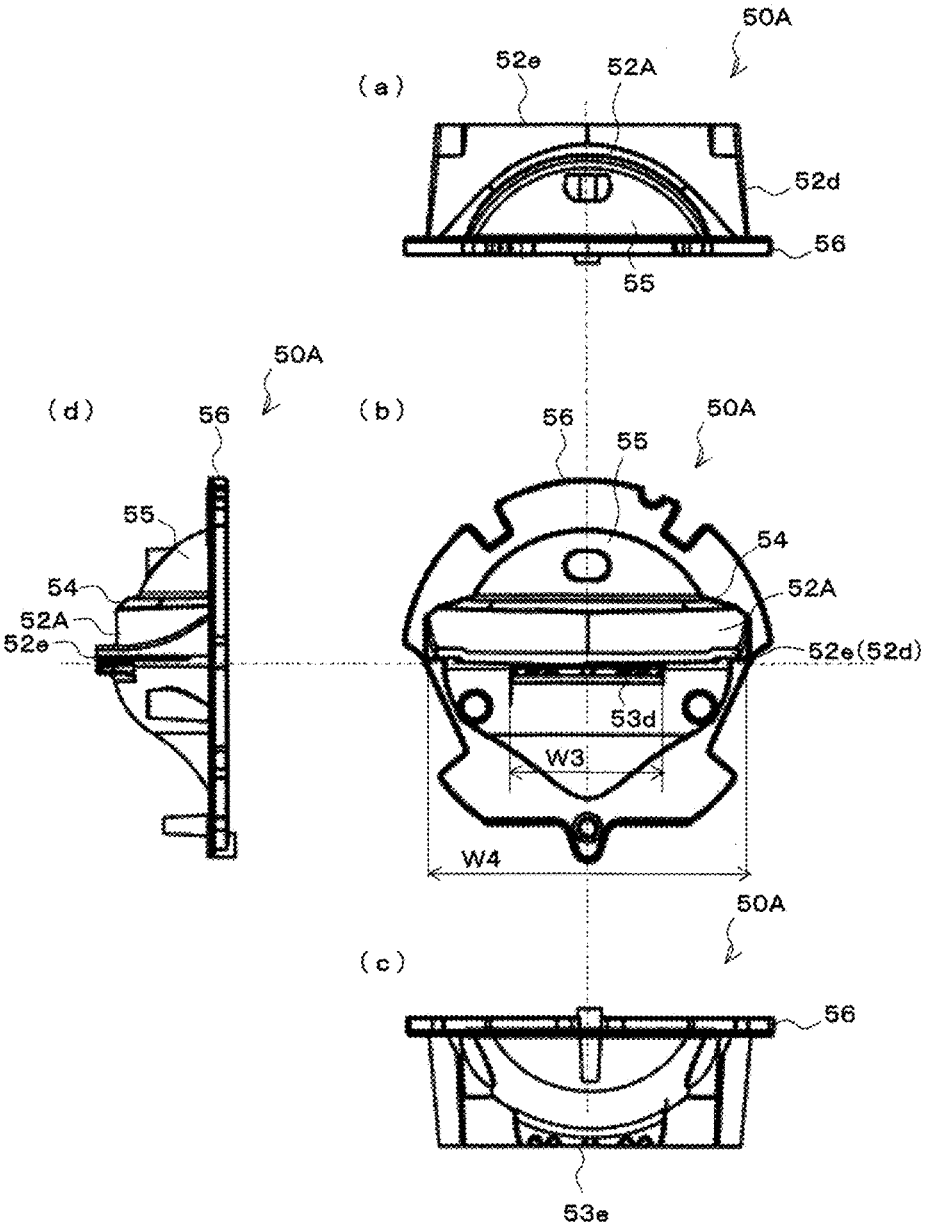
FIG. 15(*a*) is a top view of the separator 50A, (*b*) is a rear view thereof, (*c*) is a bottom view thereof, and (*d*) is a side view thereof.

FIG. 14 is a perspective view of the separator 50A, FIG. 15(*a*) is a top view of the separator 50A, FIG. 15(*b*) is a rear view thereof, FIG. 15(*c*) is a bottom view thereof, and FIG. 15(*d*) is a side view thereof.

The separator 50A is made of a silicon resin, and is a cup-shaped member in which a front side is opened and a rear side is closed, as shown in FIG. 14 and the like.

As shown in FIG. 12, the separator 50A includes an upper separator body 52A, a first light guide portion 52*d*, a first extension portion 54, a second extension portion 55, a lower separator body 53, a second light guide portion 53*d*, and a flange portion 56, which are configured as a single part integrally molded.

The upper separator body 52A is disposed above the reference axis AX, and the lower separator body 53 is disposed below the reference axis AX.

The upper separator body 52A is a thin plate-shaped light guide portion including a front surface 52Aa and a rear surface 52Ab on the opposite side thereof. Specifically, the upper separator body 52A is a thin plate-shaped light guide portion, in a horizontal cross-section, curved along the rear surface 60Ab (the upper light incident surface 60Ab1) of the primary lens 60A (see FIG. 13), and, in a vertical cross-section, extending upward (see FIG. 12). The lower edge of the front surface 52Aa of the upper separator body 52A includes a stepped edge portion 52*a*1 (not shown in FIG. 12) with a shape corresponding to the cut-off line $CL_{Lo}$ (CL1 to CL3, as in the first embodiment described above.

As shown in FIG. 12 and the like, the upper separator body 52A is disposed in a state in which the front surface 52Aa faces the rear surface 60Ab (the upper light incident surface 60Ab1) of the primary lens 60A.

The lower portion of the front surface 52Aa of the upper separator body 52A is in surface contact with the lower portion of the rear surface 60Ab (the upper light incident surface 60Ab1) of the primary lens 60A. Further, a space S is formed between a portion above the lower portion of the front surface 52Aa of the upper separator body 52A and a portion above the lower portion of the rear surface 60Ab (the upper light incident surface 60Ab1) of the primary lens 60A.

The distance (space S) between the front surface 52Aa of the upper separator body 52A and the rear surface 60Ab (the upper light incident surface 60Ab1) of the primary lens 60A increases upward. A relationship between the front surface 52Aa of the upper separator body 52A and the rear focal plane FP of the projection lens 90 (curvature of field. see FIG. 12) is also the same.

Incidentally, since the light from the low-beam light sources 32*a* outputted from the first light guide portion 52*d* of the upper separator body 52A (the front surface 52Aa) becomes diffused light, the light reaching the rear surface 60Ab (the upper light incident surface 60Ab1) of the primary lens 60A weakens as the distance (space S) between the front surface 52Aa of the upper separator body 52A and the rear surface 60Ab (the upper light incident surface 60Ab1) of the primary lens 60A becomes wider (i.e., upward from the reference axis AX). As a result, the low-beam light distribution pattern becomes an ideal luminous intensity distribution that decreases in a gradation manner from the upper edge downward.

The vertical length H1 (see FIG. 12) of the portion (surface contact portion) where the lower portion of the front surface 52Aa of the upper separator body 52A and the lower portion of the rear surface 60*b* (the upper light incident surface 60Ab1) of the primary lens 60A are in surface contact with each other is, for example, 0.7 mm. The provision of the surface contact portion can form a high luminous intensity band with a relatively high luminous intensity in the vicinity of the cut-off line of the low-beam light distribution pattern. Further, the adjustment of the length H1 can adjust the vertical length of the high luminous intensity band.

Figure 17:
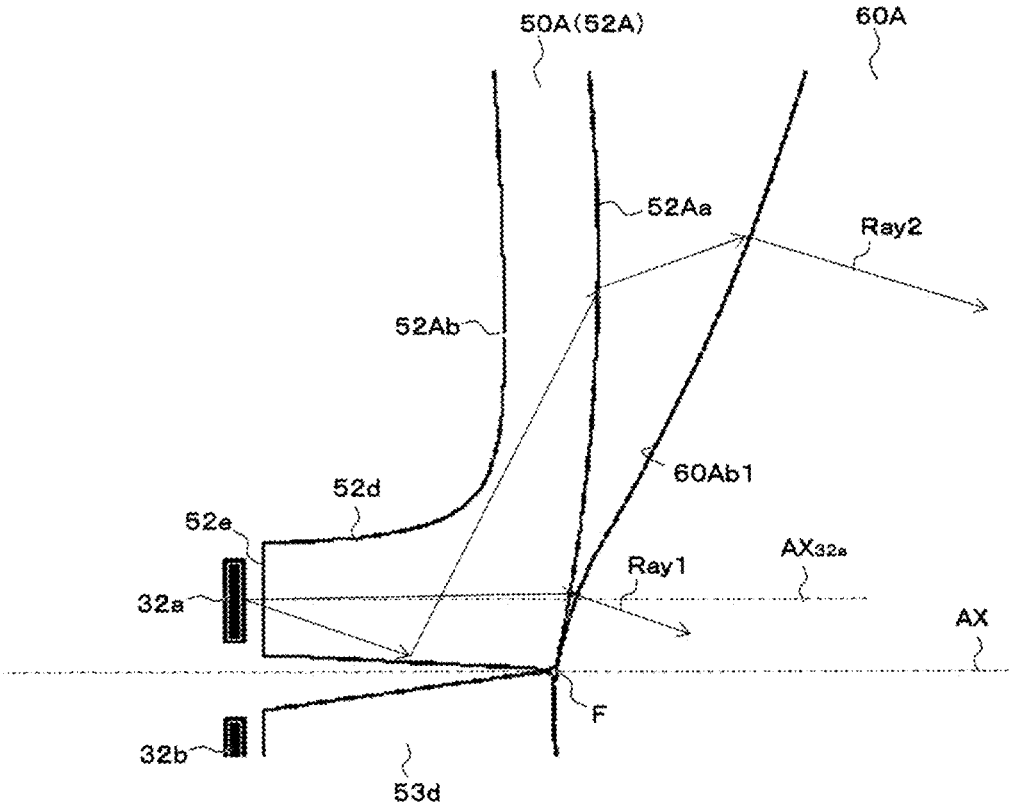
FIG. 17 is a diagram for explaining optical paths of the light from the low-beam light source 32*a*.

The front surface 52Aa of the upper separator body 52A is configured to be, for example, a slightly convex curved surface to the front such that the light from the low-beam light sources 32*a* to be guided through the upper separator body 52A while being repeatedly totally reflected between the front surface 52Aa and the rear surface 52Ab of the upper separator body 52A is outputted from the front surface 52Aa of the upper separator body 52A (see FIG. 17). The rear surface 52Ab of the upper separator body 52A is also configured to be a slightly convex curved surface similarly to the front.

The thickness T of the upper separator body 52A (see FIG. 12) is, for example, 2 mm in consideration of moldability and the like. Further, the vertical length H2 of the upper separator body 52A (see FIG. 12) is, for example, 7 mm in consideration of the vertical length (thickness) of the low-beam light distribution pattern. The adjustment of the length H2 can adjust the vertical length of the low-beam light distribution pattern.

As shown in FIG. 12, the first light guide portion 52*d* is a thin plate-shaped light guide portion including an upper surface 52*d*1 and a lower surface 52*d*2 on the opposite side thereof. The first light guide portion 52*d* extends from the lower portion of the upper separator body 52A (rear surface 52Ab) toward the low-beam light sources 32*a*, and has a first light incident surface 52*e* provided at the tip end thereof and facing the low-beam light sources 32*a*. The first light incident surface 52*e* is a surface through which the light from the low-beam light sources 32*a* enters the separator 50A (the first light guide portion 52*d*), and is, for example, a plane parallel to a plane including the Y-axis and the Z-axis.

The first extension portion 54 and the second extension portion 55 are so-called bridging portions for which no optical function is intended. The first extension portion 54 extends from the upper end portion of the upper separator body 52A toward the front. The second extension portion 55 extends from the front end portion of the first extension portion 54 along the rear surface 60Ab of the primary lens 60A.

The lower separator body 53 is a thin plate-shaped light guide portion including a front surface 53*a* and a rear surface 53*b* on the opposite side thereof. The upper edge of the front surface 53*a* of the lower separator body 53 includes a stepped edge portion 53*a*1 of the shape obtained by inverting the stepped edge portion 52*a*1, similarly to the above-described first embodiment (not shown in FIG. 12).

The second light guide portion 53*d* extends from the upper portion of the lower separator body 53 (rear surface 53*b*) toward the ADB light sources 32*b* and has a second light incident surface 53*e* provided at the tip end thereof and facing the ADB light sources 32*b*. The second light incident surface 53*e* is a surface through which the light from the ADB light sources 32*b* enters the separator 50A (the second light guide portion 53*d*) and is, for example, a plane parallel to a plane including the Y-axis and Z-axis.

Figure 16:
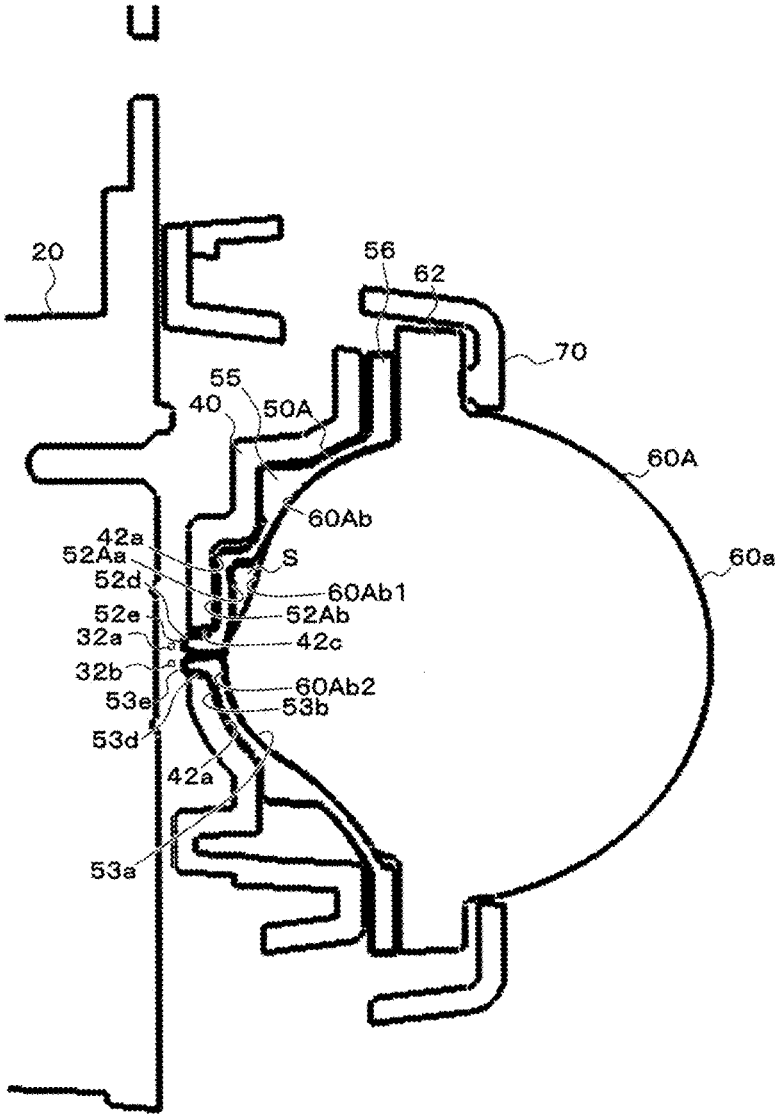
FIG. 16 is a diagram showing an example of a holding structure of the separator 50A and a primary lens 60A.

FIG. 16 shows an example of a holding structure for the separator 50A and the primary lens 60A.

As shown in FIG. 16, the separator 50A with the above-described configuration is interposed between the holder 40 and the retainer 70 together with the primary lens 60A. Specifically, the first light guide portion 52*d* and the second light guide portion 53*d* are inserted into the through holes 42*c* of the holder 40, and the separator 50A is interposed between the holder 40 and the retainer 70 together with the primary lens 60A in such a state that the first light incident surface 52*e* and the low-beam light sources 32*a* (the light emitting surfaces) face each other, the second light incident surface 53*e* and the ADB light sources 32*b* (the light emitting surfaces) face each other, and the rear surface (the rear surfaces 52Ab and 53*b*, etc.) of the separator 50A is in surface contact with the front surface 42*a* of the holder 40 (the holder body 42).

The primary lens 60A is made of a transparent resin such as an acrylic resin or a polycarbonate resin, and is a spherical lens including a front surface 60*a* and a rear surface 60Ab on the opposite side thereof as shown in FIG. 12. The front surface 60*a* is a spherical surface convex to the front, and the rear surface 60Ab is a spherical surface convex to the rear. The primary lens 60A is provided with a flange portion 62, which extends so as to surround the reference axis AX between the front surface 60*a* and the rear surface 60Ab.

The rear surface 60Ab of the primary lens 60A includes an upper light incident surface 60Ab1 disposed above the reference axis AX and a lower light incident surface 60Ab2 disposed below the reference axis AX.

The upper light incident surface 60Ab1 is a surface through which light from the low-beam light sources 32*a* outputted from the front surface 52Aa of the upper separator body 52A enters the primary lens 60A. The upper light incident surface 60Ab1 is provided in a region of the rear surface 60Ab of the primary lens 60A to which the front surface 52Aa of the upper separator body 52A faces.

The lower portion of the upper light incident surface 60Ab1 coincides with the rear focal plane FP of the projection lens 90. On the other hand, the portion above the lower portion of the upper light incident surface 60Ab1 does not coincide with the rear focal plane FP of the projection lens 90, but is inclined forward with respect to the rear focal plane FP.

The surface shape of the upper light incident surface 60Ab1 is adjusted in such a manner that it satisfies the legal requirements required for the low-beam light distribution pattern, luminous intensity at a portion (e.g., a portion around 4 degrees below the horizontal line) of the low-beam light distribution pattern can be suppressed from becoming relatively high, and the thickness of the pattern in the vertical direction becomes uniform with respect to the horizontal direction (i.e., it is possible to suppress the light distribution feeling from being reduced). For example, the surface shape of the upper light incident surface 60Ab1 is adjusted in such a manner that the luminous intensity distribution of the low-beam light distribution pattern decreases in a gradation manner from the upper edge of the low-beam light distribution pattern downward. It should be noted that in some cases, the surface shape of the front surface 52Aa of the upper separator body 52A may be adjusted in the same manner.

Since the surface shape of the thus adjusted upper light incident surface 60Ab1 becomes a complex free curved surface, it is difficult to represent the surface shape of the upper light incident surface 60Ab1 by specific numerical values and the like.

However, it is possible to find the surface shape of the upper light incident surface 60Ab1 that forms the low-beam light distribution pattern—that satisfies the legal requirements required for the low-beam light distribution pattern, is capable of suppressing luminous intensity at a portion (e.g., a portion around 4 degrees below the horizontal line) of the low-beam light distribution pattern from becoming relatively high, and uniforms the thickness of the pattern in the vertical direction with respect to the horizontal direction, (i.e., it is possible to suppress the light distribution feeling from being reduced)—by, for example, using a predetermined simulation software to adjust the surface shape of the upper light incident surface 60Ab1, and by, each time it is adjusted, confirming the low-beam light distribution pattern (luminous intensity distribution, etc.).

The lower light incident surface 60Ab2 is a surface through which light from the ADB light sources 32*b* outputted from the front surface 53*a* of the lower separator body 53 enters the primary lens 60A. The lower light incident surface 60Ab2 is provided in a region of the rear surface 60Ab of the primary lens 60A to which the front surface 53*a* of the lower separator body 53 faces. The lower light incident surface 60Ab2 coincides with the rear focal plane FP of the projection lens 90.

As shown in FIG. 16, the primary lens 60A with the above-described configuration is interposed between the holder 40 and the retainer 70 together with the separator 50A. Specifically, the primary lens 60A with the above-described configuration is interposed between the holder 40 and the retainer 70 together with the separator 50A in such a state that the flange portion 62 is in contact with the flange portion 56 of the separator 50A, a portion of the rear surface 60Ab is in surface contact with the second extension portion 55 of the separator 50A, the lower portion of the rear surface 60Ab (the upper light incident surface 60Ab1) is in surface contact with the lower portion of the front surface 52Aa of the upper separator body 52A, the rear surface 60Ab (the lower light incident surface 60Ab2) is in surface contact with the front surface 53*a* of the lower separator body 53, and a space S is formed between the front surface 52Aa of the upper separator body 52 and the rear surface 60Ab (the upper light incident surface 60Ab1) of the primary lens 60A.

Figure 20:
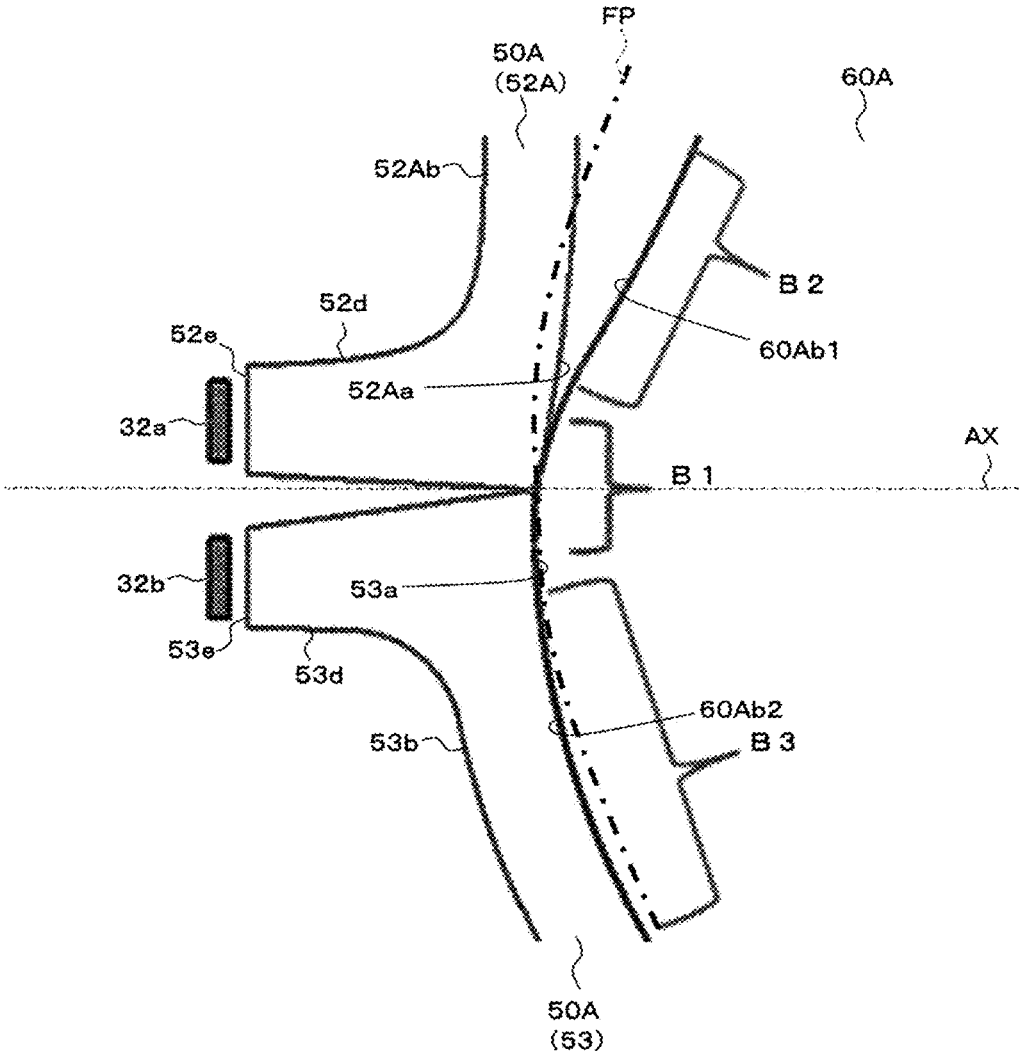
FIG. 20 is a diagram for explaining the relationship between an upper light incident surface 60Ab1 and a lower light incident surface 60Ab2 of the primary lens 60A and a focal plane FP of a projection lens 90.

FIG. 20 is a diagram for describing the relationship between the upper light incident surface 60Ab1 and the lower light incident surface 60Ab2 of the primary lens 60A and the focal plane FP of the projection lens 90.

As shown in FIG. 20, assume a case in which the lower portion of the upper light incident surface 60Ab1 of the primary lens 60A and the upper portion of the lower light incident surface 60Ab2 of the primary lens 60A are defined as a first region B1, a portion above the lower portion of the upper light incident surface 60Ab1 of the primary lens 60A is defined as a second region B2, and a portion below the upper portion of the lower light incident surface 60Ab2 of the primary lens 60A is defined as a third region B3. In this case, the first region B1 coincides with the focal plane FP of the projection lens 90, the second region B2 is disposed forward with respect to the focal plane FP of the projection lens 90 (or rearward), and the third region B3 is disposed rearward with respect to the focal plane FP of the projection lens 90 (or forward).

The distance between the second region B2 and the focal plane FP of the projection lens 90 becomes wider upward from the reference axis AX. On the other hand, the distance between the third region B3 and the focal plane FP of the projection lens 90 becomes wider downward from the reference axis AX.

It should be noted that the adjustment of the first region B1 can adjust the vertical length of the relatively high luminous intensity band with a relative high luminous intensity near the cut-off line of the low-beam light distribution pattern and the vertical length of the relatively high luminous intensity band with a relative high luminous intensity near the lower edge of the ADB light distribution pattern. Further, the adjustment of the second region B2 can adjust the vertical length of the low-beam light distribution pattern. In addition, the adjustment of the third region B3 can adjust the vertical length of the ADB light distribution pattern.

The secondary lens 80 is made of a transparent resin such as an acrylic resin or a polycarbonate resin, and is a plano-convex lens including a front surface 82*a* and a rear surface 82*b* on the opposite side thereof. The front surface 82*a* is a plane parallel to the plane including the Y-axis and Z-axis, and the rear surface 82*b* is a convex spherical surface to the rear.

FIG. 17 is a diagram for explaining an optical path of light from the low-beam light sources 32*a*.

In the vehicle lighting fixture 10A with the above-described configuration, when the low-beam light sources 32*a* are turned on, light from the low-beam light sources 32*a* enters the separator 50A (the first light guide portion 52*d*) through the first light incident surface 52*e*.

As shown in FIG. 17, of the light from the low-beam light sources 32*a* that has entered the separator 50A (the first light guide portion 52*d*), a part of light, for example, light Ray1 with a relatively strong luminous intensity (e.g., light in the narrow angle direction with respect to the optical axis AX32*a* of the low-beam light sources 32*a*) is directly outputted from the lower portion of the front surface 52Aa of the upper separator body 52A, further enters the primary lens 60A through the upper light incident surface 60Ab1 of the primary lens 60A, and is projected by the projection lens 90 constituted by the primary lens 60A and the secondary lens 80, to be used for forming the low-beam light distribution pattern.

Figure 27:
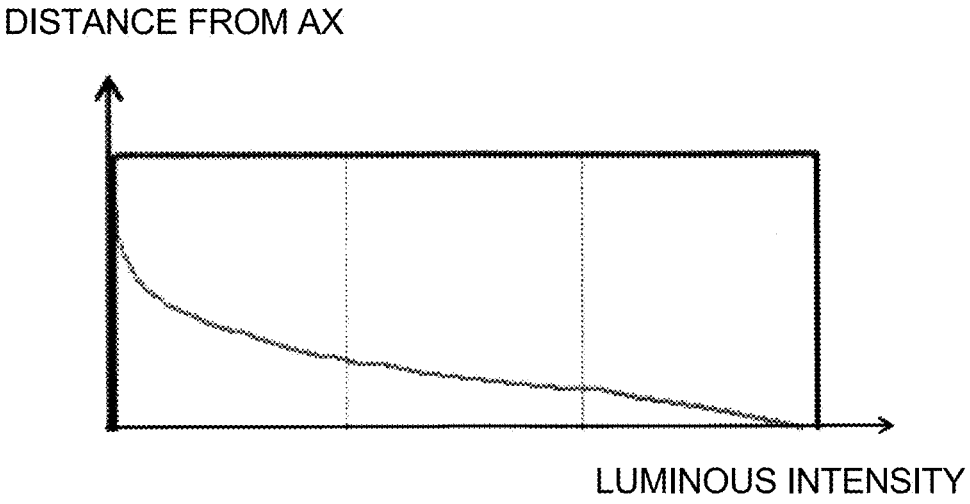
FIG. 27 is a graph showing a luminous intensity distribution of light that has been guided through the upper separator body 52A while being repeatedly totally reflected between the front surface 52Aa and the rear surface 52Ab of the upper separator body 52A, so that the light is outputted from the front surface 52Aa of the upper separator body 52A.

Further, of the light from the low-beam light source 32*a* that has entered the separator 50A (the first light guide portion 52*d*), another part of light, for example, light Ray2 with a relatively weak luminous intensity (e.g., light in the wide angle direction with respect to the optical axis AX32*a* of the low-beam light sources 32*a*) is guided within the upper separator body 52A while being repeatedly totally reflected between the front surface 52Aa and the rear surface 52Ab of the upper separator body 52A to be outputted through the front surface 52Aa of the upper separator body 52A, further enters the primary lens 60A through the upper light incident surface 60Ab1 of the primary lens 60A, and is projected by the projection lens 90 constituted by the primary lens 60A and the secondary lens 80, to be used for forming the low-beam light distribution pattern. FIG. 27 is a graph showing the luminous intensity distribution of light that is guided within the upper separator body 52A while being repeatedly totally reflected between the front surface 52Aa and the rear surface 52Ab of the upper separator body 52A to be outputted through the front surface 52Aa of the upper separator body 52A.

Figure 18:
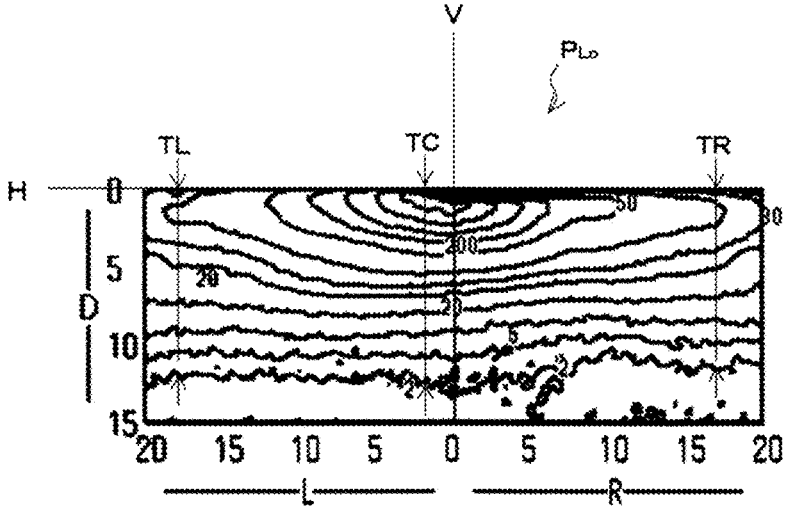
FIG. 18 is a diagram showing an example of a low-beam light distribution pattern $P_{Lo}$ formed by the vehicle lighting fixture 10A.

The present inventors have confirmed that the low-beam light distribution pattern formed as described above satisfies the legal requirements for the low-beam light distribution pattern, as shown in FIG. 18, the luminous intensity at a portion (e.g., a portion around 4 degrees below the horizontal line H) of the low-beam light distribution pattern can be suppressed from becoming relatively high, and the thickness of the pattern in the vertical direction with respect to the horizontal direction becomes uniform (i.e., thicknesses TC, TL, and TR become uniform, so that the light distribution feeling can be prevented from being reduced). FIG. 18 shows an example of a low-beam light distribution pattern $P_{Lo}$ formed by the vehicle lighting fixture 10A.

Although the detailed reason why the luminous intensity at a portion (e.g., a portion around 4 degrees below the horizontal line) of the low-beam light distribution pattern is not high is unknown, it can be considered as follows.

That is, since the space S is formed between the front surface 52Aa of the upper separator body 52A and the rear surface 60Ab (the upper light incident surface 60Ab1) of the primary lens 60A, the light Ray1 with the relatively strong luminous intensity out of the light from the low-beam light sources 32*a* that has entered the separator 50A (the first light guide portion 52*d*) is refracted (diffused), and further, Fresnel reflected each time when it is outputted through the front surface 52Aa of the upper separator body 52A and when the light enters the primary lens 60A through the rear surface 60Ab (the upper light incident surface 60Ab1) of the primary lens 60A. As a result, it is considered that light travelling toward the portion (e.g., a portion around 4 degrees below the horizontal line) of the low-beam light distribution pattern is reduced.

The detailed reason why the vertical thickness is uniformly formed with respect to the horizontal direction is unknown, but the following can be considered.

Specifically, it is considered that, since the space S is formed between the front surface 52Aa of the upper separator body 52A and the rear surface 60Ab (the upper light incident surface 60Ab1) of the primary lens 60A, the light Ray1 with the relatively strong luminous intensity out of the light from the low-beam light sources 32*a* that has entered the separator 50A (the first light guide portion 52*d*) is refracted (diffused) when entering the primary lens 60A through the rear surface 60Ab (the upper light incident surface 60Ab1) of the primary lens 60A, and a part of the light is projected to a portion (mainly, the lower region of the central portion) with a relatively low luminous intensity in the low-beam light distribution pattern by the projection lens 90 constituted by the primary lens 60A and the secondary lens 80.

Further, it is considered to be because the light from the low-beam light sources 32*a* guided within the upper separator body 52A while being repeatedly totally reflected between the front surface 52Aa and the rear surface 52Ab of the upper separator body 52A and outputted from the front surface 52Aa of the upper separator body 52A is projected to a portion (mainly, the lower region of the central portion) with a relatively low luminous intensity in the low-beam light distribution pattern by the projection lens 90 constituted by the primary lens 60A and the secondary lens 80.

In addition, the present inventors have confirmed that the low-beam light distribution pattern formed as described above has a longer vertical length (T3<T4 in FIG. 19(*b*)), a lower density (narrower bright range), and a lower maximum luminous intensity than the ADB light distribution pattern $PA_{DB}$, as shown in FIG. 19(*b*). FIG. 19(*b*) shows an example of the ADB light distribution pattern and the low-beam light distribution pattern formed when the separator 50A shown in FIG. 20 is used.

The reason why the low-beam light distribution pattern becomes long in the vertical direction as compared with the ADB light distribution pattern is considered that the second region B2 is arranged forward with respect to the focal plane FP of the projection lens 90 (or rearward), and thus the light from the low-beam light sources 32*a* that has outputted from the front surface 52Aa of the upper separator body 52A and entered the primary lens 60A through the upper light incident surface 60Ab1 of the primary lens 60A is projected in a blurred state by the projection lens 90 constituted by the primary lens 60A and the secondary lens 80.

Further, the reason why the low-beam light distribution pattern has a lower density (narrower bright range) and lower maximum luminous intensity, as compared with the ADB light distribution pattern, is the same reason as the reason why the luminous intensity at a portion (e.g., a portion around 4 degrees below the horizontal line) of the above-described low-beam light distribution pattern is not high.

It should be noted that the reason why the width W2 of the low-beam light distribution pattern $P_{Lo}$ is wider than the width W1 of the ADB light distribution pattern $P_{ADB}$ in FIG. 19(*b*) is that, as shown in FIG. 15(*b*), the width W4 of the first light guide portion 52*d* through which the light from the low-beam light sources 32*a* is guided is wider than the width W3 of the second light guide portion 53*d* through which the light from the ADB light source 32*b* is guided.

It should be noted that, when the ADB light sources 32*b* are turned on, the ADB light distribution pattern $P_{ADB}$ is formed, and when the low-beam light sources 32*a* and the ADB light sources 32*b* are turned on, the composite light distribution pattern including the low-beam light distribution pattern $P_{Lo}$ and the ADB light distribution pattern $PA_{DB}$ is formed. This point of issue is the same as that of the first embodiment, and therefore the description thereof is omitted here.

In addition, the present inventors have confirmed that the contour of the ADB light distribution pattern formed as described above is formed in an appropriately blurred state.

The reason why the contour of the ADB light distribution pattern is formed in an appropriately blurred state is considered that, since the third region B3 is disposed rearward with respect to the focal plane FP of the projection lens 90 (or frontward), the light from the ADB light source 32*b* outputted from the front surface 53*a* of the lower separator body 53 and further and entering the primary lens 60A from the lower light incident surface 60Ab2 of the primary lens 60A is projected in a blurred state by the projection lens 90 constituted by the primary lens 60A and the secondary lens 80.

As described above, according to the present embodiment, there can be provided the vehicle lighting fixture 10A capable of suppressing the luminous intensity at a portion (e.g., a portion around 4 degrees below the horizontal line) of the low-beam light distribution pattern from becoming relatively high, and capable of forming the low-beam light distribution pattern with a uniform thickness in the vertical direction with respect to the horizontal direction (i.e., capable of suppressing the light distribution feeling from being reduced).

Further, according to the present embodiment, there can be provided the vehicle lighting fixture 10A capable of forming the low low-beam light distribution pattern with a longer length in the vertical direction, a lower density (narrow bright range), and a low maximum luminous intensity, as compared with the ADB light distribution pattern, and the ADB light distribution pattern whose contour is appropriately blurred.

Figure 22:
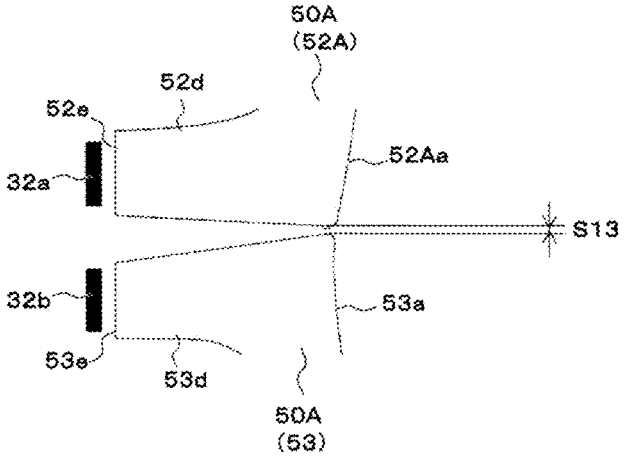
FIG. 22(*a*) is a diagram for explaining a gap S13 between the front surface 52Aa of the upper separator body 52A and the front surface 53*a* of the lower separator body 53 through which light from the ADB light source 32*b* is outputted and (*b*) is a diagram showing an example of a composite light distribution pattern including a low-beam light distribution pattern and an ADB light distribution pattern when the gap S13 is formed.
Figure 22:
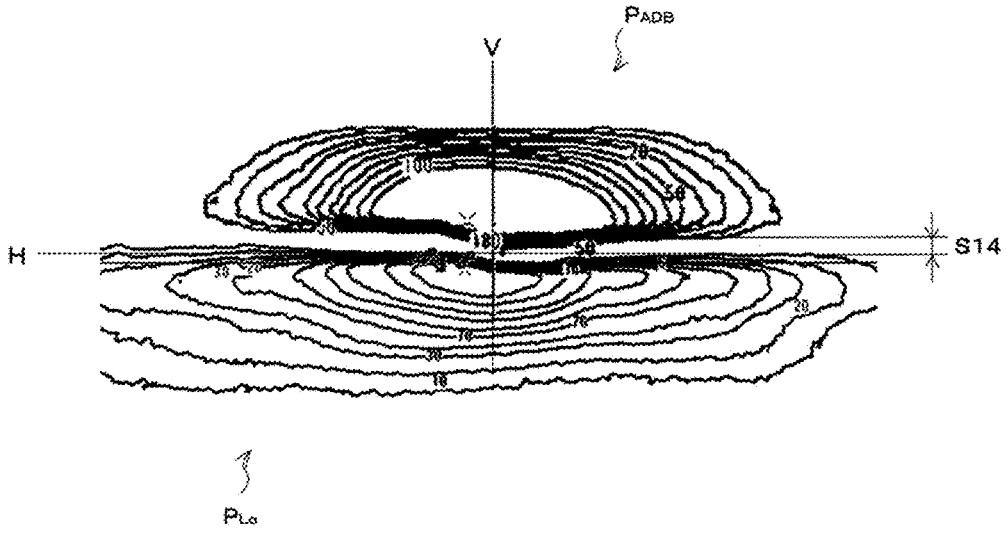

The present inventors have studied and found that, in the conventional vehicle lighting fixture with the above-described conventional art configuration, a gap S13 is generated in some cases between the front surface 52Aa of the upper separator body 52A, through which the light from the low-beam light sources 32*a* is outputted, and the front surface 53*a* of the lower separator body 53, through which the light from the ADB light sources 32*b* is outputted, as shown in FIG. 22(*a*), due to the molding variation of the separator 50A or temperature change, and that when the gap S13 is generated, as shown in FIG. 22(*b*), the luminous intensity at an area between the low-beam light distribution pattern $P_{Lo}$ and the ADB light distribution pattern $P_{ADB}$ (see symbol S14 in FIG. 22(*a*)) is abruptly reduced, so that the light distribution feeling is reduced. FIG. 22(*a*) is a diagram for explaining the gap S13 between the front surface 52Aa of the upper separator body 52A and the front surface 53*a* of the lower separator body 53 through which the light from the ADB light sources 32*b* is outputted, and FIG. 22(*b*) is a diagram showing an example of a composite light distribution pattern including the low-beam light distribution pattern and the ADB light distribution pattern when the gap S13 is formed.

Next, as a third embodiment, a description regarding a vehicle lighting fixture 10B will be described, which is capable of smoothening the luminous intensity change between the low-beam light distribution pattern $P_{Lo}$ and the ADB light distribution pattern $P_{ADB}$ and suppressing the light distribution feeling from being reduced, even when a gap S13 is generated between the front surface 52Aa of the upper separator body 52A, through which the light from the low-beam light sources 32*a* is outputted, and the front surface 53*a* of the lower separator body 53, through which the light from the ADB light sources 32*b* is outputted.

The vehicle lighting fixture 10B of the present embodiment is different from the vehicle lighting fixture 10A of the above-described second embodiment in that a separator 50B is used instead of the separator 50A. Except for this, the configuration is the same as that of the above-described second embodiment. Hereinafter, differences from the above-described second embodiment will be mainly described, and similar components are denoted by the same reference numerals, and descriptions thereof will be omitted as appropriate.

Figure 23:
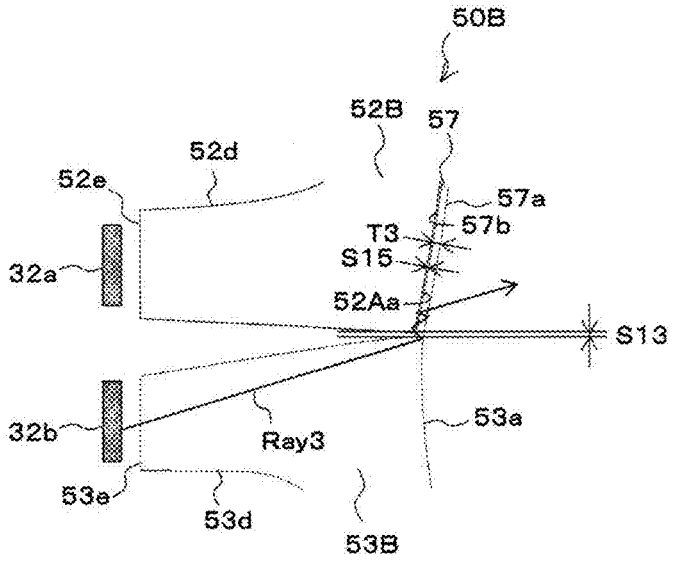
FIG. 23 is a partial longitudinal cross-sectional view of a separator 50B.
Figure 24:
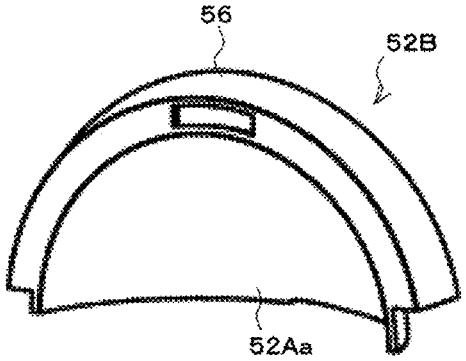
FIG. 24(*a*) is a perspective view of an upper separator body 52B and (*b*) is a perspective view of a lower separator body 53B.
Figure 24:
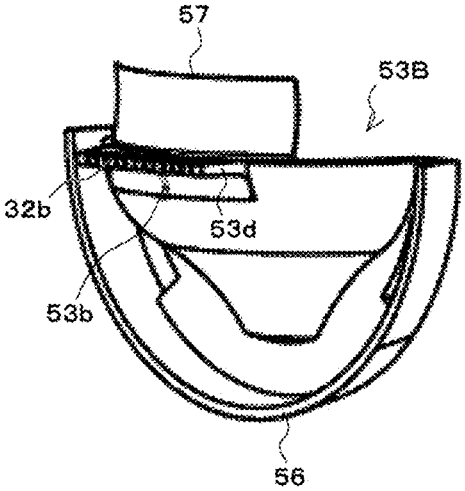

FIG. 23 is a partial longitudinal cross-sectional view of the separator 50B. FIG. 24(*a*) is a perspective view of an upper separator body 52B, and FIG. 24(*b*) is a perspective view of a lower separator body 53B.

The separator 50B shown in FIG. 23 is constituted by combining the upper separator body 52B and the lower separator body 53B shown in FIG. 24.

The separator 50B is different from the separator 50A of the above-described second embodiment in that, as shown in FIGS. 23 and 24(*b*), the upper portion of the front end portion of the lower separator body 53B includes an overlap portion 57 extending upward. Except for this, the structure is the same as that of the separator 50A of the above-described second embodiment. Hereinafter, differences from the separator 50A of the above-described second embodiment will be mainly described, and similar components are denoted by the same reference numerals and descriptions thereof will be omitted as appropriate.

As shown in FIG. 23, the overlap portion 57 is a thin-film light guide portion including a front surface 57*a* facing the upper light incident surface 60Ab1 of the primary lens 60A (not shown in FIG. 23), and a rear surface 57*b* facing the gap S13 between the lower portion (the front surface 52Aa) of the upper separator body 52B and the upper portion (the front surface 53*a*) of the lower separator body 53B and the front surface 52Aa of the upper separator body 52B.

The thickness T3 of the overlap portion 57 is, for example, 0.2 mm. It should be noted that, in order to suppress the transmittance of light from the low-beam light sources 32*a* outputted through the front surface 52Aa of the upper separator body 52B from being reduced, it is desirable that the thickness T3 of the overlap portion 57 be as thin as possible.

The overlap portion 57 is disposed with the gap S15 formed between the rear surface 57*b* of the overlap portion 57 and the front surface 52Aa of the upper separator body 52B so that the light Ray3 from the ADB light sources 32*b* guided within the overlap portion 57 while being repeatedly totally reflected between the front surface 57*a* and the rear surface 57*b* of the overlap portion 57 is outputted through the front surface 57*a* of the overlap portion 57. The gap S15 is, for example, 0.02 mm.

In the vehicle lighting fixture 10B with the above-described configuration, when the low-beam light sources 32*a* and the ADB light sources 32*b* are simultaneously turned on, light from the low-beam light sources 32*a* enters the separator 50B (the first light guide portion 52*d*) through the first light incident surface 52*e*.

Of the light from the low-beam light sources 32*a* that has entered the separator 50B (the first light guide portion 52*d*), a part of light, for example, light Ray1 with a relatively strong luminous intensity (e.g., see FIG. 17) is directly outputted from the lower portion of the front surface 52Aa of the upper separator body 52B, passes through the overlap portion 57, further enters the primary lens 60A through the upper light incident surface 60Ab1 of the primary lens 60A, and is projected by the projection lens 90 constituted by the primary lens 60A and the secondary lens 80, to be used for forming the low-beam light distribution pattern.

Further, of the light from the low-beam light sources 32*a* which has entered the separator 50B (the first light guide portion 52*d*), another part of light, for example, light Ray2 with a relatively weak luminous intensity (e.g., see FIG. 17) is guided within the upper separator body 52B while being repeatedly totally reflected between the front surface 52Aa and the rear surface 52Ab of the upper separator body 52B to be outputted through the front surface 52Aa of the upper separator body 52B, passes through the overlap portion 57, further enters the primary lens 60A through the upper light incident surface 60Ab1 of the primary lens 60A, and is projected by the projection lens 90 constituted by the primary lens 60A and the secondary lens 80, to be used for forming the low-beam light distribution pattern.

On the other hand, the light from the ADB light sources 32*b* enters the separator 50B (the second light guide portion 53*d*) through the second light incident surface 53*e*.

Of the light from the ADB light sources 32*b* that has entered the separator 50B (the second light guide portion 53*d*), a part thereof is directly outputted from the upper portion of the front surface 53*a* of the lower separator body 53B, further enters the primary lens 60A through the lower light incident surface 60Ab2 of the primary lens 60A, and is projected by the projection lens 90 constituted by the primary lens 60A and the secondary lens 80, to be used for forming the ADB light distribution pattern.

As shown in FIG. 23, of the light from the ADB light source 32*b* that has entered the separator 50B (the second light guide portion 53*d*), another part thereof (refer to a light beam indicated by reference numeral Ray3 in FIG. 23) is guided within the overlap portion 57 while being repeatedly totally reflected between the front surface 57*a* and the rear surface 57*b* of the overlap portion 57 to be outputted through the front surface 57*a* of the overlap portion 57, and is further projected between the low-beam light distribution pattern (the lower portion) and the ADB light distribution pattern (upper portion) by the projection lens 90 constituted by the primary lens 60A and the secondary lens 80.

Figure 25:
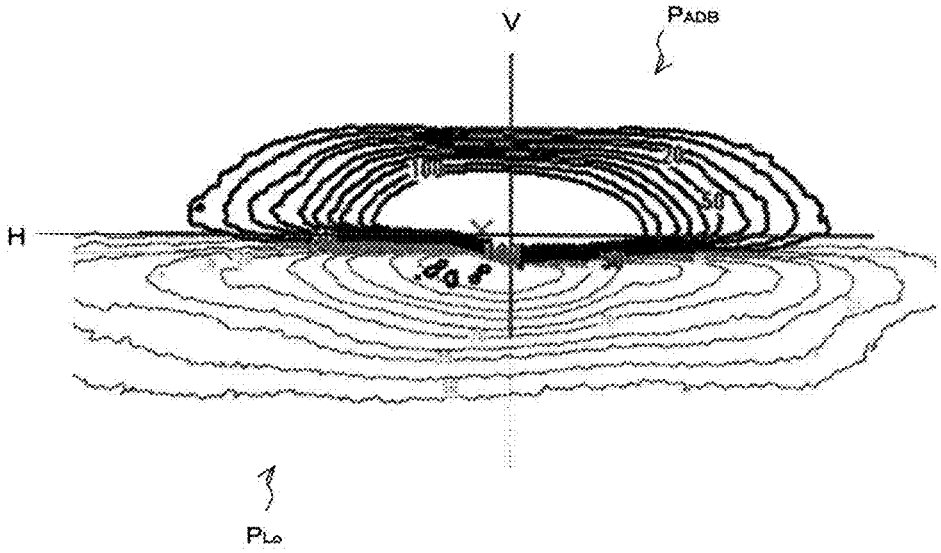
FIG. 25 is a diagram showing an example of a composite light distribution pattern including a low-beam light distribution pattern $P_{Lo}$ and an ADB light distribution pattern $P_{ADB}$ formed by the vehicle lighting fixture 10B.

The present inventors have confirmed that the composite light distribution pattern including the low-beam light distribution pattern and the ADB light distribution pattern formed as described above is configured such that the luminous intensity change between the low-beam light distribution pattern $P_{Lo}$ and the ADB light distribution pattern $P_{ADB}$ becomes smooth, as shown in FIG. 25, so that it is possible to suppress the light distribution feeling from being reduced. FIG. 25 shows an example of a composite light distribution pattern including the low-beam light distribution pattern $P_{Lo}$ and the ADB light distribution pattern $P_{ADB}$ formed by the vehicle lighting fixture 10B.

As described above, according to the present embodiment, there can be provided a vehicle lighting fixture 10B capable of smoothening the luminous intensity change between the low-beam light distribution pattern $P_{Lo}$ and the ADB light distribution pattern $P_{ADB}$ and suppressing the light distribution feeling from being reduced even when the gap S13 is generated between the front surface 52Aa of the upper separator body 52B, through which the light from the low-beam light sources 32*a* is outputted, and the front surface 53*a* of the lower separator body 53B, through which the light from the ADB light sources 32*b* is outputted.

Next, a modified example will be described.

Figure 26:
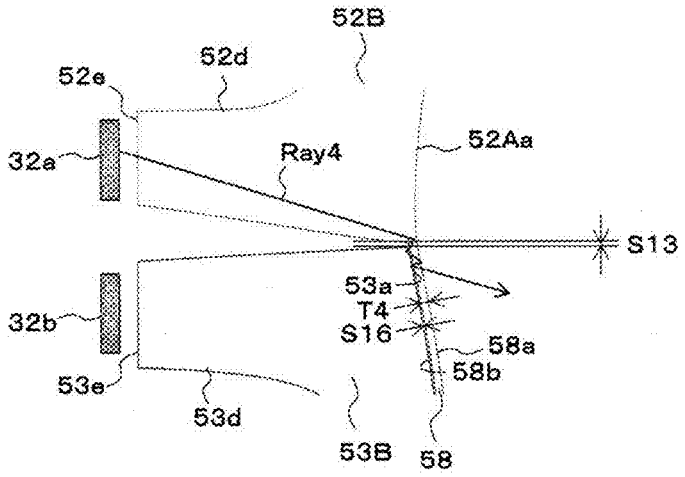
FIG. 26 is a partial longitudinal cross-sectional view of the separator 50B (modified example).

FIG. 26 is a partial longitudinal cross-sectional view of the separator 50B (modified example).

In the third embodiment described above, an example has been described in which the overlap portion 57 in which the upper portion of the front end portion of the lower separator body 53B extends upward is used as the overlap portion, but the present invention is not limited thereto. For example, as shown in FIG. 26, an overlap portion 58 in which the lower portion of the front end portion of the upper separator body 52B extends downward may be used as the overlap portion.

The overlap portion 58 is a thin-film light guide portion including a front surface 58*a* facing the lower light incident surface 60Ab2 (not shown in FIG. 26) of the primary lens 60A, and a rear surface 58*b* facing a gap S13 between the lower portion (the front surface 52Aa) of the upper separator body 52B and the upper portion (the front surface 53*a*) of the lower separator body 53B and the front surface 53*a* of the lower separator body 53B.

The thickness T4 of the overlap portion 58 is, for example, 0.2 mm. It should be noted that, in order to suppress the transmittance of light from the ADB light sources 32*b* outputted through the front surface 53*a* of the lower separator body 53B from being reduced, it is desirable that the thickness T4 of the overlap portion 58 be as thin as possible.

The overlap portion 58 is disposed with the gap S16 formed between the rear surface 58*b* of the overlap portion 58 and the front surface 53*a* of the lower separator body 53B so that the light from the low-beam light sources 32*a* guided within the overlap portion 58 while being repeatedly totally reflected between the front surface 58*a* and the rear surface 58*b* of the overlap portion 58 is outputted through the front surface 58*a* of the overlap portion 58. The gap S16 is, for example, 0.02 mm.

In this modified example, when the low-beam light sources 32*a* and the ADB light sources 32*b* are simultaneously turned on, light from the low-beam light sources 32*a* enters the separator 50B (the first light guide portion 52*d*) through the first light incident surface 52*e*.

Of the light from the low-beam light sources 32*a* that has entered the separator 50B (the first light guide portion 52*d*), light Ray1 with a relatively strong luminous intensity (e.g., see FIG. 17) is directly outputted from the lower portion of the front surface 52Aa of the upper separator body 52B, passes through the overlap portion 58, further enters the primary lens 60A through the upper light incident surface 60Ab1 of the primary lens 60A, and is projected by the projection lens 90 constituted by the primary lens 60A and the secondary lens 80, to be used for forming the low-beam light distribution pattern.

Further, of the light from the low-beam light sources 32*a* which has entered the separator 50B (the first light guide portion 52*d*), light Ray2 with a relatively weak luminous intensity (e.g., see FIG. 17) is guided within the upper separator body 52B while being repeatedly totally reflected between the front surface 52Aa and the rear surface 52Ab of the upper separator body 52B to be outputted through the front surface 52Aa of the upper separator body 52B, further enters the primary lens 60A through the upper light incident surface 60Ab1 of the primary lens 60A, and is projected by the projection lens 90 constituted by the primary lens 60A and the secondary lens 80, to be used for forming the low-beam light distribution pattern.

Furthermore, of the light from the low-beam light sources 32*b* that has entered the separator 50B (the first light guide portion 52*d*), another part thereof (refer to a light beam indicated by reference numeral Ray4 in FIG. 26) is guided within the overlap portion 58 while being repeatedly totally reflected between the front surface 58*a* and the rear surface 58*b* of the overlap portion 58 to be outputted through the front surface 58*a* of the overlap portion 58, and is further projected between the low-beam light distribution pattern (lower portion) and the ADB light distribution pattern (upper portion) by the projection lens 90 constituted by the primary lens 60A and the secondary lens 80.

On the other hand, the light from the ADB light sources 32*b* enters the separator 50B (the second light guide portion 53*d*) through the second light incident surface 53*e*.

Of the light from the ADB light sources 32*b* that has entered the separator 50B (the second light guide portion 53*d*), a part thereof is directly outputted from the upper portion of the front surface 53*a* of the lower separator body 53B, further enters the primary lens 60A through the lower light incident surface 60Ab2 of the primary lens 60A, and is projected by the projection lens 90 constituted by the primary lens 60A and the secondary lens 80, to be used for forming the ADB light distribution pattern.

The present inventors have confirmed that the composite light distribution pattern including the low-beam light distribution pattern and the ADB light distribution pattern formed as described above is configured such that the luminous intensity change between the low-beam light distribution pattern $P_{Lo}$ and the ADB light distribution pattern $PA_{DB}$ becomes smooth, as shown in FIG. 25, so that it is possible to suppress the light distribution feeling from being reduced.

In the above-described third embodiment, an example in which the overlap portion 57 is applied to the separator 50A of the vehicle lighting fixture 10A of the second embodiment has been described, but the present invention is not limited thereto. For example, the overlap portion 57 may be applied to the separator 50 of the vehicle lighting fixture 10A of the first embodiment and the other separators. The same applies to the overlap portion 58.

In the above-described embodiment, an example has been described in which the projection lens 90 constituted by two lenses, i.e., the primary lens 60A and the secondary lens 80, is used as the projection lens, but the present invention is not limited thereto. For example, although not shown, a projection lens constituted by a single lens or a projection lens constituted by three or more lenses may be used as the projection lens.

In the above-described embodiment, an example in which the separator 50A including the upper separator body 52A, the first light guide portion 52*d*, the lower separator body 53, and the second light guide portion 53*d* is used as the separator has been described, but the present invention is not limited thereto. For example, similarly to the above-described conventional art, a separator including the upper separator body 52A and the first light guide portion 52*d* and not including the lower separator body 53 and the second light guide portion 53*d* may be used as the separator. That is, the lower separator body 53 and the second light guide portion 53*d* may be omitted.

Figure 21:
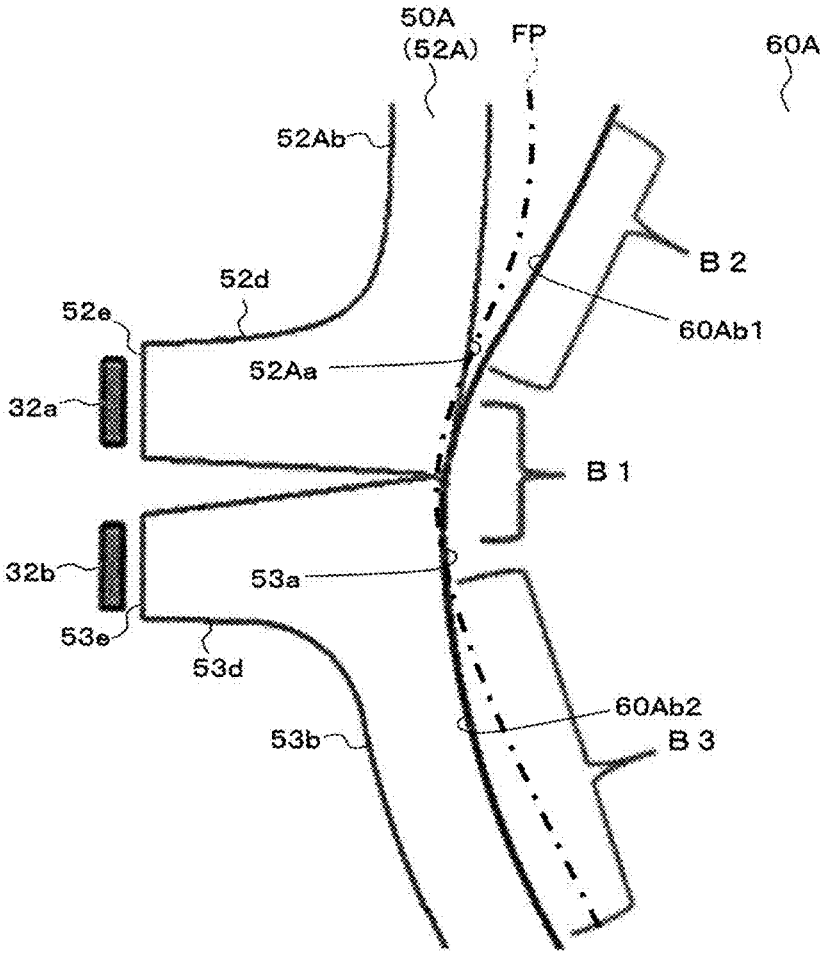
FIG. 21 is a modified example of the focal plane FP of the projection lens 90.

In the above-described embodiment, an example in which a spherical surface that has a constant curvature (see FIG. 20) is used as the focal plane FP of the projection lens 90 has been described, but the present invention is not limited thereto. For example, as shown in FIG. 21, as the focal plane FP of the projection lens 90, a spherical surface whose curvature changes unevenly may be used. FIG. 21 is a modified example of the focal plane FP of the projection lens 90.

All of the numerical values shown in the above-described respective embodiments are illustrative, and it is needless to say that appropriate numerical values different from those may be used.

The above-described embodiments are merely illustrative in all respects. The present invention is not to be construed as being limited by the description of the above-described respective embodiments. The invention may be embodied in various other modes without departing from the spirit or principal characteristics thereof.

REFERENCE SIGNS LIST

10 . . . Vehicle lighting fixture, 20 . . . Heat sink, 22 . . . Base, 22*a* . . . Front surface, 22*a*1 . . . Light source module mounting surface, 22*a*2 . . . Peripheral surface, 22*a*3 . . . Holder abutment surface, 22*a*4 . . . Retainer abutment surface, 22*a*5 . . . Screw hole, 22*a*6 . . . Positioning pin, 22*b* . . . Rear surface, 22*c* . . . Screw hole, 24 . . . first extension portion, 26 . . . second extension portion, 28 . . . Heat dissipation fin, 30 . . . Light source module, 32*a* . . . Low-beam light source, 32*b* . . . ADB light source, 34 . . . Substrate, 34*a* . . . Through hole, 34*c* . . . Connector, 40 . . . Holder, 40*a* . . . Front side open end surface, 42 . . . Holder body, 42*a* . . . Front surface, 42*c* . . . Through hole, 44 . . . Cylindrical portion, 46 . . . Flange portion, 48 . . . Projected portion, 49 . . . Projected portion, 50, 50A . . . Separator, 52, 52A . . . Upper separator portion, 52*a*, 52Aa . . . Front surface, 52*a*1 . . . Stepped edge portion, 52*a*2 . . . Extended edge portion, 52*a*3 . . . Extended edge portion, 52*b*, 52Ab . . . Rear surface, 52*c* . . . Lower end surface, 52*d* . . . First light guide portion, 52*e* . . . First light incident surface, 52*f* . . . Flange portion, 52*f*1 . . . Through hole, 52*f*2 . . . Through hole, 52*g* . . . Light guide portion, 52*h* . . . Light incident surface, 53 . . . Lower separator body, 53*a* . . . Front surface, 53*a*1 . . . Stepped edge portion, 53*a*2 . . . Extended edge portion, 53*a*3 . . . Extended edge portion, 53*b* . . . Rear surface, 53*c* . . . Upper end surface, 53*d* . . . Second light guide portion, 53*e* . . . Second light incident surface, 53*f* . . . Flange portion, 53*f*1 . . . Through hole, 53*g* . . . Light guide portion, 53*h* . . . Light incident surface, 60, 60A . . . Primary lens, 60*a* . . . Front surface, 60*b*, 60Ab . . . Rear surface, 60Ab1 . . . Upper light incident surface, 60Ab2 . . . Lower light incident surface, 62 . . . Flange portion, 70 . . . Retainer, 72 . . . Retainer body, 76 . . . Flange portion, 80 . . . Secondary lens, 82 . . . Lens body, 82*a* . . . Front surface, 82*b* . . . Rear surface, 84 . . . Cylindrical portion, 86 . . . Pressing and screw receiving portion, 88 . . . Positioning pin, AX . . . Reference axis, CL . . . Cut-off line, CL1 . . . Left horizontal cut-off line, CL2 . . . Right horizontal cut-off line, CL3 . . . Cut-off line, $CL_{ADB}$ . . . Cut-off line, $CL_{Lo}$, . . . Cut-off line, F . . . Focus, N1, N2 . . . Screw, $P_{ADB}$ . . . ADB light distribution pattern, $P_{Lo}$, . . . Low-beam pattern.

The invention claimed is:

1. A vehicle lighting fixture comprising: a projection lens; a separator disposed behind the projection lens; and a low-beam light source that is disposed behind the separator and emits light for forming a low-beam light distribution pattern by being irradiated forward through the separator and the projection lens in this order, wherein the separator includes an upper separator body that has a front surface and a rear surface on an opposite side thereof, and a first light guide portion that extends from a lower portion of the upper separator body toward the low-beam light source and has a first light incident surface located at a tip end thereof and faces the low-beam light source;

the projection lens has a front surface and a rear surface on an opposite side thereof, and the rear surface of the projection lens has an upper light incident surface facing the front surface of the upper separate body;

the low-beam light source, the first light guide portion, the upper separator body, and the upper light incident surface are each disposed above a reference axis passing through the focal point of the projection lens and extending in a vehicle longitudinal direction;

the lower portion of the front surface of the upper separator body is in surface contact with a lower portion of the upper light incident surface of the rear surface of the projection lens;

a space is formed between a portion above the lower portion of the front surface of the upper separator body and a portion above the lower portion of the upper light incident surface of the rear surface of the projection lens; and the light emitted from the low-beam light source enters the first light guide portion through the first light incident portion, and a part of the light is directly outputted from the front surface of the upper separator body, and another part of the light is guided within the upper separator body while being repeatedly totally reflected between the front surface and the rear surface of the upper separator body and then outputted through the front surface of the upper separator body and further enters the projection lens through the upper light incident surface of the projection lens to be projected by the projection lens, so that the light is used for forming the low-beam light distribution pattern.

2. The vehicle lighting fixture according to claim 1, wherein a distance between the front surface of the upper separator body and the upper light incident surface of the rear surface of the projection lens becomes wider upward.

3. The vehicle lighting fixture according to claim 2, wherein a surface shape of the upper light incident surface of the rear surface of the projection lens is adjusted in such a manner that a luminous intensity distribution of the low-beam light distribution pattern satisfies legal requirements and a thickness of the low-beam light distribution pattern in a vertical direction is uniform with respect to a horizontal direction.

4. The vehicle lighting fixture according to claim 3 further comprising an Adaptive Driving Beam (ADB) light source that emits light that is irradiated forward while passing the separator and the projection lens in this order to form an ADB light distribution pattern, and wherein the separator includes a lower separator body that has a front surface and a rear surface on an opposite side thereof, and a second light guide portion that extends from an upper portion of the lower separator body toward the ADB light source and has a second light incident surface located at a tip end thereof and facing the ADB light source;

the rear surface of the projection lens further has a lower light incident surface facing the front surface of the lower separator body;

the ADB light source, the second light guide portion, the lower separator body, and the lower light incident surface are each disposed below the reference axis; and the front surface of the lower separator body is in surface contact with the lower light incident surface of the rear surface of the projection lens.

5. The vehicle lighting fixture according to claim 2 further comprising an Adaptive Driving Beam (ADB) light source that emits light that is irradiated forward while passing the separator and the projection lens in this order to form an ADB light distribution pattern, and wherein the separator includes a lower separator body that has a front surface and a rear surface on an opposite side thereof, and a second light guide portion that extends from an upper portion of the lower separator body toward the ADB light source and has a second light incident surface located at a tip end thereof and facing the ADB light source;

the rear surface of the projection lens further has a lower light incident surface facing the front surface of the lower separator body;

the ADB light source, the second light guide portion, the lower separator body, and the lower light incident surface are each disposed below the reference axis; and the front surface of the lower separator body is in surface contact with the lower light incident surface of the rear surface of the projection lens.

6. The vehicle lighting fixture according to claim 1 further comprising an Adaptive Driving Beam (ADB) light source that emits light that is irradiated forward while passing the separator and the projection lens in this order to form an ADB light distribution pattern, and wherein the separator includes a lower separator body that has a front surface and a rear surface on an opposite side thereof, and a second light guide portion that extends from an upper portion of the lower separator body toward the ADB light source and has a second light incident surface located at a tip end thereof and facing the ADB light source;

the rear surface of the projection lens further has a lower light incident surface facing the front surface of the lower separator body;

the ADB light source, the second light guide portion, the lower separator body, and the lower light incident surface are each disposed below the reference axis; and the front surface of the lower separator body is in surface contact with the lower light incident surface of the rear surface of the projection lens.

7. The vehicle lighting fixture according to claim 1, wherein a surface shape of the upper light incident surface of the rear surface of the projection lens is adjusted in such a manner that a luminous intensity distribution of the low-beam light distribution pattern satisfies legal requirements and a thickness of the low-beam light distribution pattern in a vertical direction is uniform with respect to a horizontal direction.

* * * * *